US008720524B2

(12) United States Patent
Spencer

(10) Patent No.: US 8,720,524 B2
(45) **Date of Patent: *May 13, 2014**

(54) LAYERED BLINDS

(76) Inventor: Benjamin R. Spencer, Portland, ME (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/470,783

(22) Filed: May 22, 2009

(65) Prior Publication Data

US 2009/0288782 A1 Nov. 26, 2009

Related U.S. Application Data

(63) Continuation of application No. 11/281,609, filed on Nov. 18, 2005, now Pat. No. 7,537,041.

(60) Provisional application No. 60/630,247, filed on Nov. 24, 2004.

(51) Int. Cl.
*A47H 1/00* (2006.01)

(52) U.S. Cl.
USPC ..... 160/126; 160/237; 160/220

(58) Field of Classification Search
USPC ..... 160/168.1 V, 176.1 V, 168.1 P, 176.1 P, 160/1, 5, 7, 184, 197, 231.1, 236, 900, 160/DIG. 17, 85, 86, 185, 220, 237, 120
See application file for complete search history.

(56) References Cited

U.S. PATENT DOCUMENTS

| | | | | |
|---|---|---|---|---|
| 68,751 A | | 9/1867 | James | |
| 333,408 A | | 12/1885 | Hale | |
| 1,017,765 A | * | 2/1912 | Kiefer | 160/126 |
| 1,418,995 A | * | 6/1922 | Wallace | 160/126 |
| 1,713,452 A | * | 5/1929 | Schiff | 160/120 |
| 1,789,655 A | * | 1/1931 | Iwata | 160/173 R |
| 1,810,899 A | | 6/1931 | Boehm | |
| 2,029,675 A | | 2/1936 | Schlamp | |
| 2,142,822 A | * | 1/1939 | Moore | 160/120 |
| 2,244,300 A | | 6/1941 | Kwon | |
| 2,280,358 A | * | 4/1942 | Tietig | 160/120 |
| 2,304,534 A | * | 12/1942 | Burns | 160/173 R |
| 2,549,167 A | | 4/1951 | Brubaker | |
| 2,724,434 A | | 11/1955 | Smith | |
| 2,865,446 A | * | 12/1958 | Cole | 160/85 |
| 3,444,919 A | * | 5/1969 | Karoll | 160/184 |
| 3,469,619 A | | 9/1969 | Barnett | |
| 4,240,490 A | | 12/1980 | Ford | |
| 4,594,470 A | | 6/1986 | Headrick | |
| 4,719,957 A | | 1/1988 | Strelnieks | |
| 4,757,631 A | | 7/1988 | Anson-Smith | |
| 5,142,133 A | * | 8/1992 | Kern et al. | 250/203.4 |
| 5,775,399 A | * | 7/1998 | Shields, Jr. | 160/176.1 R |
| 6,062,290 A | | 5/2000 | Domel | |
| 6,105,657 A | * | 8/2000 | Zorbas | 160/236 |
| 6,276,429 B1 | | 8/2001 | Chen | |
| 6,352,097 B1 | * | 3/2002 | Kern et al. | 160/197 |
| 6,378,567 B1 | | 4/2002 | Chen | |
| 6,582,794 B1 | | 6/2003 | Fransen | |

(Continued)

*Primary Examiner* — Blair M. Johnson

(57) ABSTRACT

A layered blinds device having a series of screens of evenly spaced rods held in parallel relation to one another that allow users to manipulate light penetration and view transparency as independent variables and a method for doing the same. A spacing mechanism adjusts the spacing between the screens which controls the light penetration while an alignment mechanism adjusts the alignment of the rods which controls the view transparency. The blinds can be adjusted manually or by a tracking system.

2 Claims, 28 Drawing Sheets

(56) References Cited

U.S. PATENT DOCUMENTS

| | | | | |
|---|---|---|---|---|
| 6,860,312 | B2 | 3/2005 | Judkins | |
| 6,880,611 | B2 * | 4/2005 | Nien | 160/236 |
| 7,059,381 | B2 | 6/2006 | Chen | |
| 7,086,444 | B2 * | 8/2006 | Nien | 160/236 |
| 7,109,461 | B2 | 9/2006 | Lasich | |
| 7,160,596 | B2 * | 1/2007 | Nien | 428/56 |
| 7,174,942 | B2 * | 2/2007 | Hsu | 160/176.1 R |
| 7,193,201 | B2 | 3/2007 | Motte | |
| 2004/0244920 | A1 * | 12/2004 | Nien | 160/236 |
| 2005/0167057 | A1 * | 8/2005 | Nien | 160/236 |
| 2005/0284587 | A1 | 12/2005 | Chen | |
| 2007/0221343 | A1 * | 9/2007 | Chen | 160/236 |
| 2010/0006238 | A1 * | 1/2010 | Cheng | 160/237 |

* cited by examiner

FULL VIEW, FULL LIGHT

SOLAR ANGLE: 30 DEGREES

FULL PRIVACY, FULL LIGHT

FULL VIEW, FULL SHADING

1500

LAYERED BLINDS

CROSS-REFERENCE TO RELATED APPLICATIONS

This application claims priority to U.S. Provisional Application No. 60/630,247 entitled "Layered Blinds", filed on Nov. 24, 2004. This application is a continuation of patent application Ser. No. 11/281,609, filed Nov. 18, 2005 (now U.S. Pat. No. 7,537,041), for all purposes including but not limited to the right of priority and benefit of earlier filing date. The entire disclosure and contents of the above applications are hereby expressly incorporated by reference for all purposes.

BACKGROUND

1. Field of the Invention

The present invention relates generally to blinds, and more particularly, to a layered blinds device that independently manipulates light and view.

2. Related Art

Blinds are found in most residences and places of business. They control light penetration and view/privacy. Blinds most commonly used today are Venetian blinds or louvered shading systems. Although adjustable, these blinds are limited in that they do not allow for the independent manipulation of light penetration and view transparency. Adjusting traditional blinds to alter light penetration inevitably influences view transparency. Likewise, adjusting traditional blinds to alter view transparency inevitably influences light penetration.

SUMMARY

The present invention is directed to a layered blinds device having a series of screens of evenly spaced rods held in parallel relation to one another that independently manipulate the passage of radiation traveling at different angles. Radiation streams can be direct solar light, solar light reflected off a surface such as a light shelf, reflected light that enters the eye or any other types of radiation traveling in straight lines at different angles. In a preferred embodiment, direct solar light and reflected light are manipulated to control light penetration and view transparency as independent variables. The embodiments set forth herein include a spacing mechanism to adjust the spacing between the screens, which controls lighting and an alignment mechanism to adjust the alignment of the rods, which controls the view. The blinds can be adjusted manually or by a tracking system. A method for independently manipulating passage of radiation traveling at different angles, particularly light penetration and view transparency, is also disclosed.

BRIEF DESCRIPTION OF THE DRAWINGS

The invention will be described in conjunction with the accompanying drawings, in which.

DETAILED DESCRIPTION

Definitions

Figure 1:
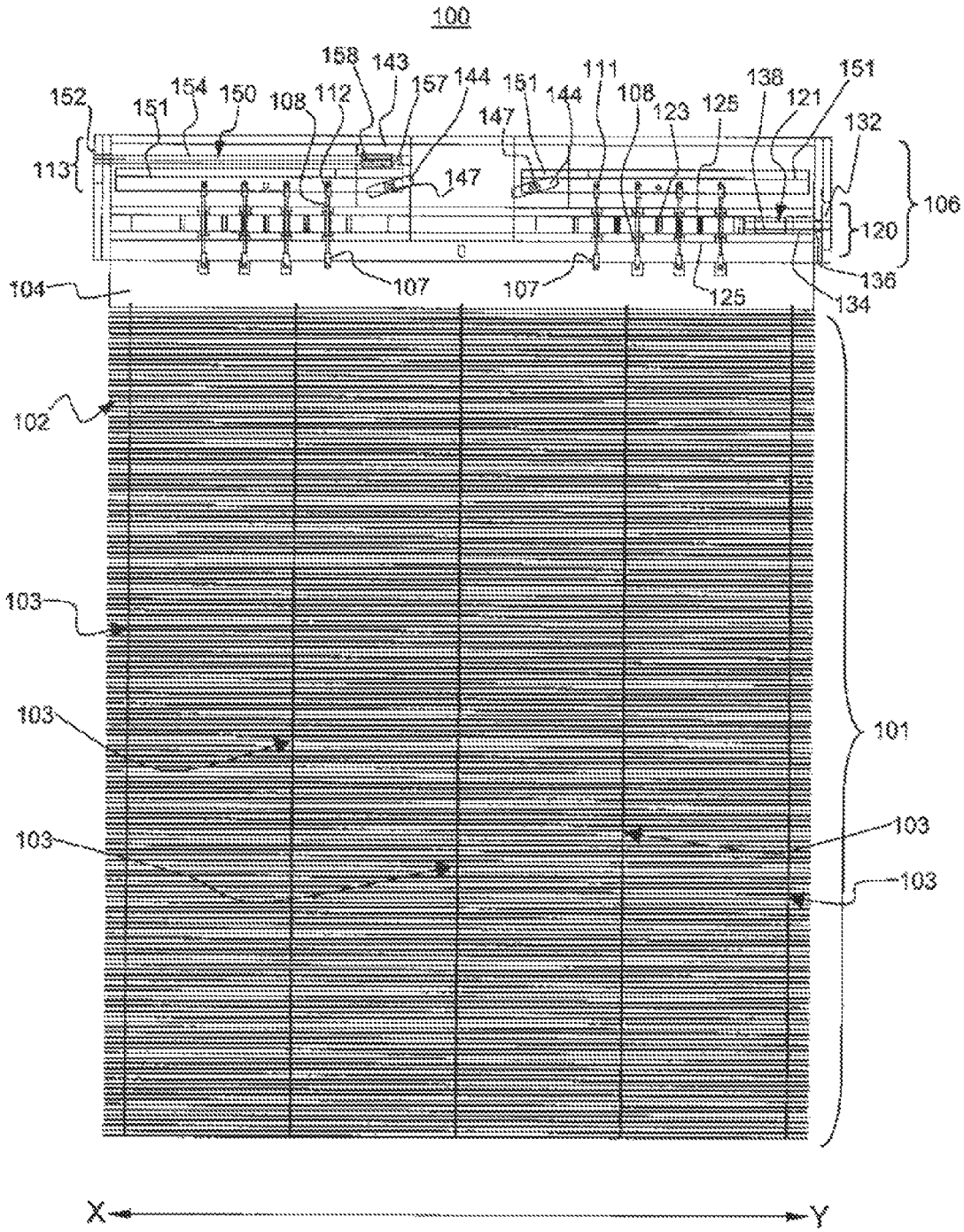
FIG. 1 is a frontal view of the layered blinds in accordance with an embodiment of the present invention.

Where the definition of terms departs from the commonly used meaning of the term, applicant intends to utilize the definitions provided below, unless specifically indicated.

For the purposes of the present invention, the term "adjusted vertical offset" refers to the measurement of the vertical distance between rods closest to one another in adjacent screens that affect desired light and view levels with the minimum relative vertical translation of adjacent screens. Adjusted vertical offset is less than or equal to the absolute value of J/2.

For the purposes of the present invention, the term "align" or "alignment" refers to getting into or forming substantially a line. The line can be vertical, horizontal, or diagonal.

For the purposes of the present invention, the term "blocked" or "blocking" refers to hindering the passage, progress, or accomplishment of by or as if by interposing an obstruction. In the present case, blocking can be full or minimal, or some degree in between.

For purposes of the present invention, the term "cleared" refers to substantially freeing from what obstructs or is unneeded. Specifically, in the present case, "cleared" refers to freeing a view from obstructing rods.

For the purposes of the present invention, the term "horizontal" refers to being substantially parallel to, in the plane of, or operating in a plane parallel to the horizon or to a base line. Specifically, in the present case, when screens are hanging parallel each other, a screen or rod moving "horizontally" is moving closer to or further from the other screens or rods of other screens.

For the purposes of the present invention, "light" refers to an electromagnetic radiation in the wavelength range including infrared, visible, ultraviolet, and X rays and traveling in a vacuum with a speed of about 186,281 miles (300,000 kilometers) per second; specifically: the part of this range that is visible to the human eye.

For the purposes of the present invention, "light penetration" refers to the amount of light that is allowed to pass through a window, e.g. full light penetration means that the maximum amount of light that can pass through the window is passing through the window.

For purposes of the present invention, "manipulate" refers to managing, controlling, or utilizing skillfully.

For the purposes of the present invention, "minimal" refers to the least possible; specifically, the least possible light penetration through a window including no penetration or the least possible view transparency through a window including no view.

For the purposes of the present invention, "radiation" refers to energy radiated in the form of waves or particles.

For the purposes of the present invention, "rod spacing" refers to the space between rods measured from the center of one rod to the center of an adjacent rod of the same screen.

For purposes of the present invention, "screen" refers to a protective or ornamental device substantially shielding an area from light and/or view.

For the purposes of the present invention, "solar angle" refers to the angle at which the sun's rays are hitting the earth's surface at any given time of day.

For the purposes of the present invention, "staggered" refers to arranging in any of various alternations or overlappings of position. Specifically, in the present invention, when adjacent, parallel rods are staggered relative to visual angle, the space between a given rod A and a given rod B on any given screen of rods is filled or partially filled by the cumulative depth of one rod from each of the remaining screens; and when parallel rods are staggered relative to solar angle, the space, relative to solar angle, between any two rods A and B a given screen is filled or partially filled by the cumulative depth of one rod from each of the remaining screens.

For the purposes of the present invention, "unadjusted vertical offset" refers to the measurement of the full vertical distance between rods in adjacent screens when said rods are moved from a base position in which they horizontally aligned to a position in which they are aligned with respect to the angle of view(Y), the angle of light(X), the view coefficient(D) and the light coefficient(E).

For the purposes of the present invention, "vertical" refers to being substantially perpendicular to the plane of the horizon or to a primary axis. Specifically, in the present case, when screens are held parallel each other, a screen or rod moving "vertically" is moving substantially up or down in relation to other screens or rods of other screens.

For the purposes of the present invention, "view transparency" refers to the degree of unobstructed view a viewer has when looking through a window; in this case, a window fitted with blinds, e.g. complete view transparency means that the blinds very minimally obstruct the view.

For the purposes of the present invention, "visual angle" refers to the angle at which the viewer is looking through a window.

For the purposes of the present invention, "window" refers to an opening between two adjacent volumes allowing for the transmission of light. In the present invention, the window may or may not include a transparent material such as glass.

Description

The present invention provides a layered blinds device for manipulating the passage of radiation traveling at different angles. In the preferred embodiment, radiation streams are direct solar light and reflected light that enters the eye; however, the radiation streams can be any type of radiation traveling in a straight line at different angles. For simplicity, the blinds device will be discussed in the context of light manipulation but does Not limit the scope of the invention.

Figure 2:
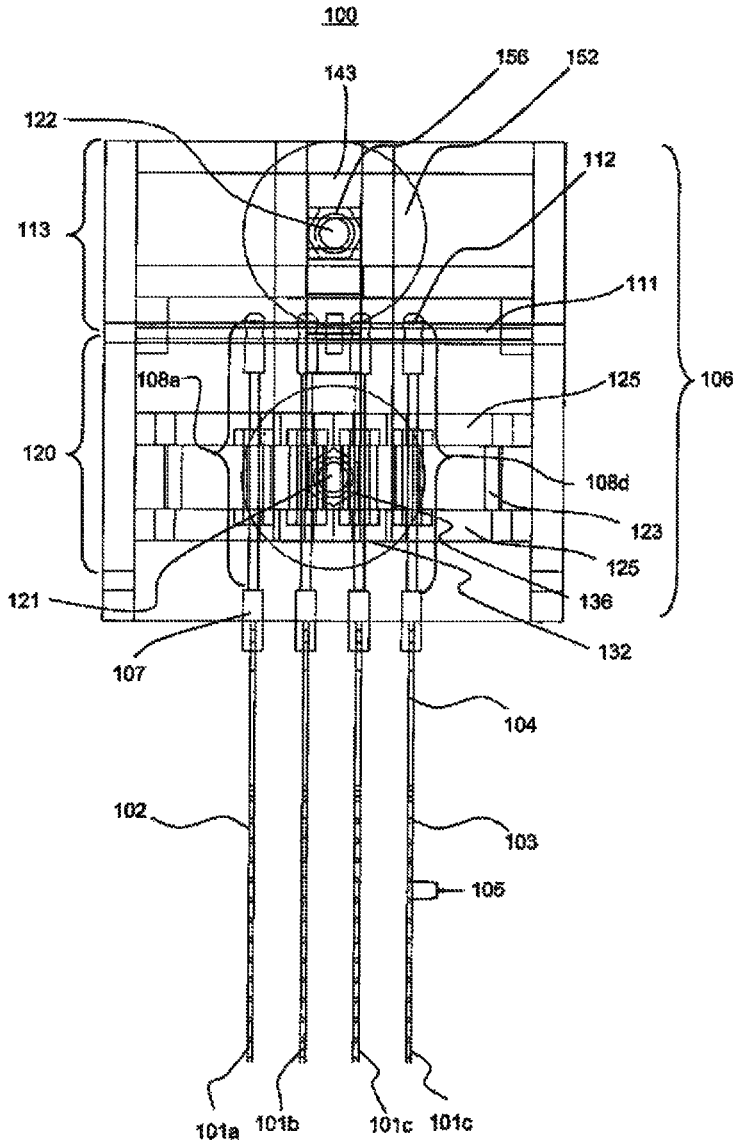
FIG. 2 is a side view of the layered blinds in accordance with an embodiment of the present invention.
Figure 15:
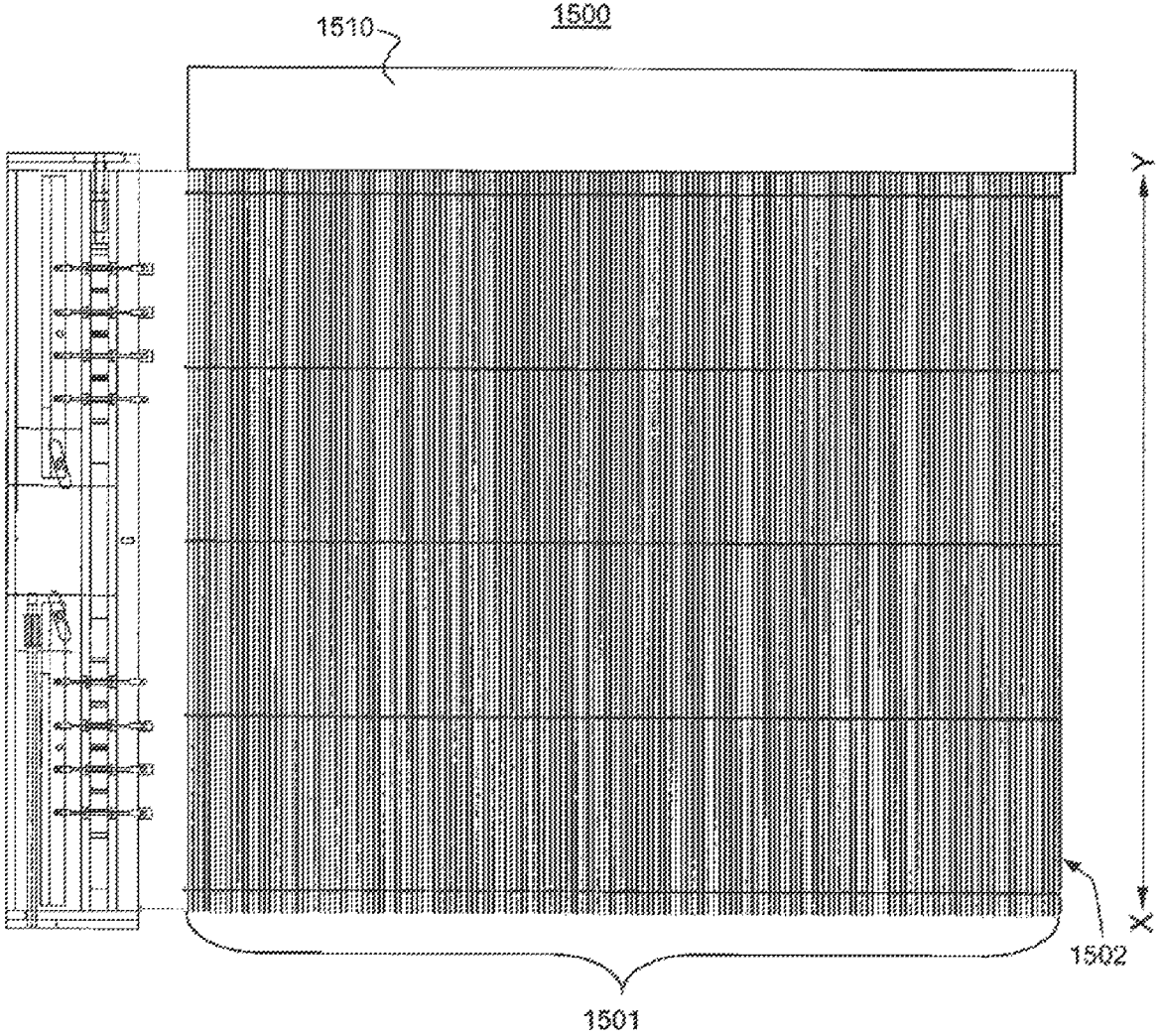
FIG. 15 is a frontal view of layered blinds oriented vertically in accordance with an embodiment of the present invention.
Figure 16:
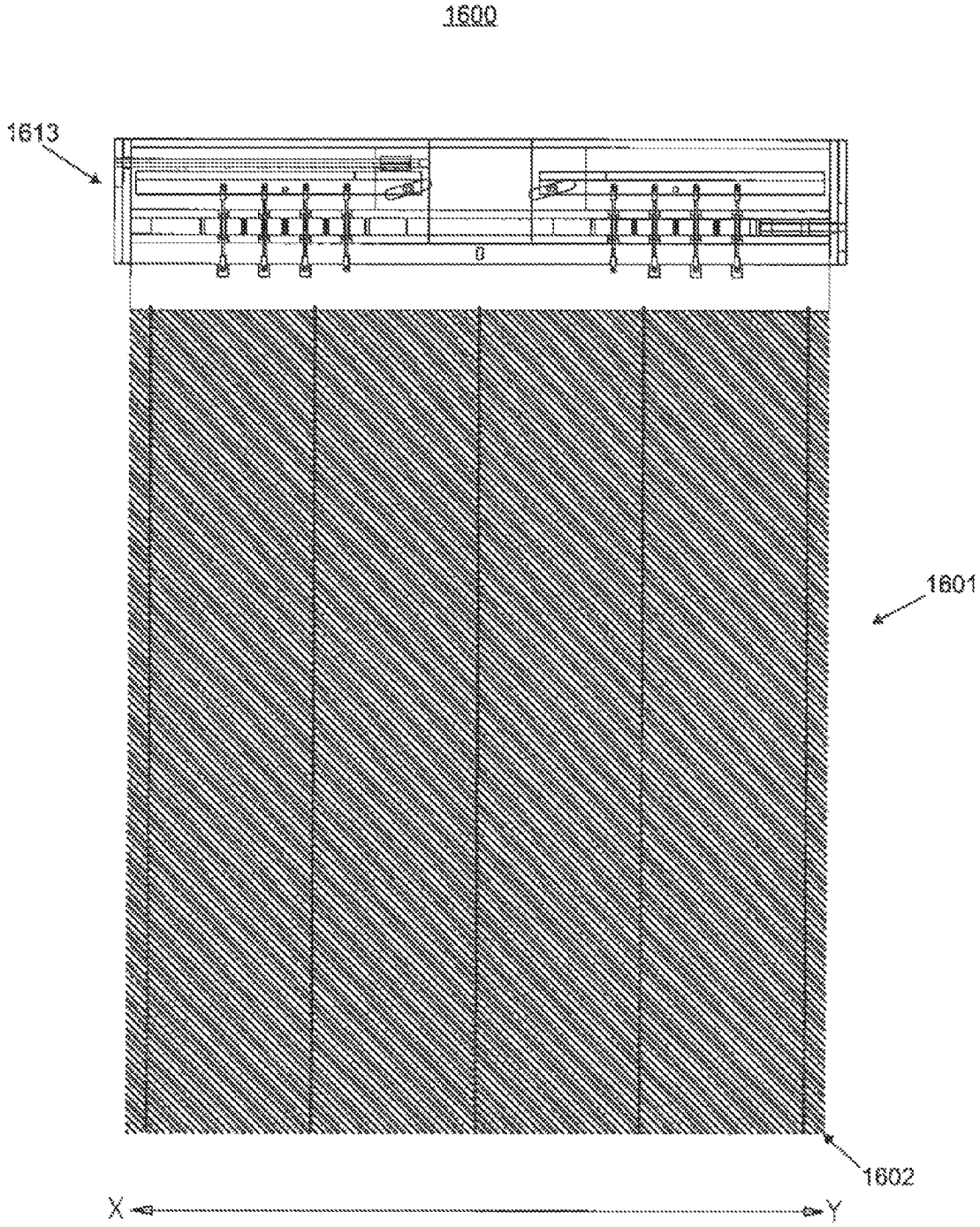
FIG. 16 is a frontal view of layered blinds oriented diagonally in accordance with an embodiment of the present invention.

The blinds device of the present invention independently manipulates light penetration and view transparency through a window. FIG. 1 shows an exemplary embodiment of the present invention. As shown in FIG. 1, a device 100 according to one embodiment of the present invention includes a plurality of screens 101 comprised of a plurality of rods 102. Rods 102 can be held horizontally as shown in FIG. 1 or rods 102 can be held vertically as shown in FIG. 15, or diagonally as shown in FIG. 16. A connecting mechanism 103 such as string, rope, or other material hold rods 102 in an evenly spaced, parallel relation to each other to form each screen 101 and connects one end of each screen 101 to holding plate 104. Connecting mechanism 103 can be flexible or rigid with flexible material being required if the device is retractable, see FIG. 17. The number of screens required is directly related to the diameter of rods 102 and the spacing 105 between rods 102 of a screen 101. FIG. 2 illustrates an embodiment of device 100 having four screens 101*a*, 101*b*, 101*c*, and 101*d* wherein the diameter of rods 102 is about one-quarter of the spacing 105 between rods 102 measured from the center of one rod to the center of an adjacent rod of the same screen. The preferred diameter of each rod depends on the window frame depth and the desired view transparency. In a typical residential window having a window frame about two inches deep, the device would include four screens having rods spacing of about ⅛ inch apart with the rod diameter being about 1/32 inch. This configuration would allow for a maximum of about 75% view transparency. In order to minimize light leakage, the rods can be slightly oversized. It is preferred that the rods are reflective plastic as such materials minimize costs and maximize recyclability; however other opaque materials would suffice.

Figure 9:
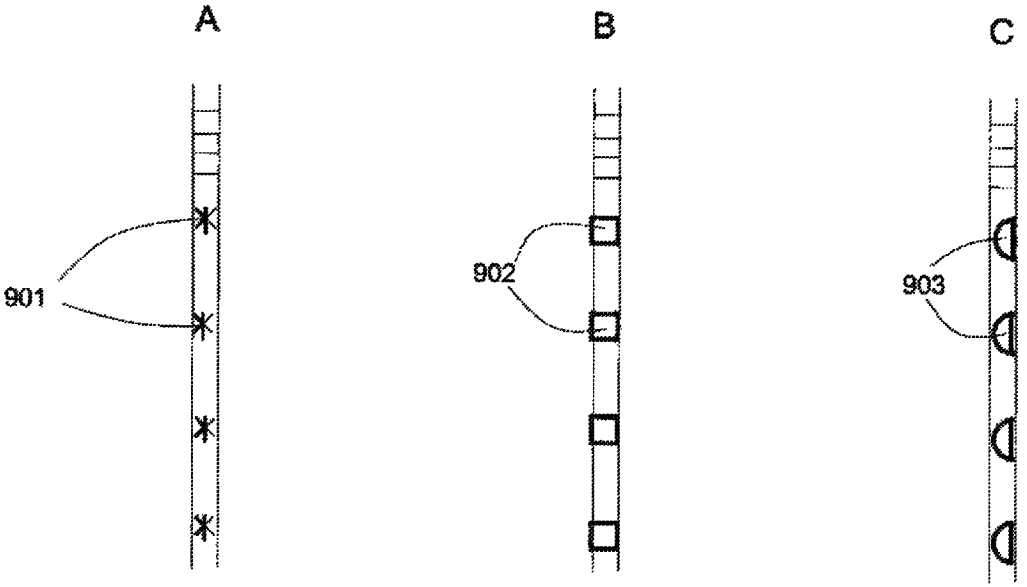
FIG. 9 is a side view of the rods of the layered blinds device with alternative rod profiles.

As shown in the figures, the rods preferably have a cylindrical profile which allows consistent blocking of light at variable solar angles. As shown in FIG. 9, different rod profiles such as a star 901 (FIG. 9A) or square 902 (FIG. 9B) would also work but would likely be less consistent in blocking light penetration at variable sun angles than the cylindrical profile. As shown in FIG. 9, rods having a partially-cylindrical profile 903 (FIG. 9C) are also a possibility, using the curved side facing the sun. This partially-cylindrical profile would provide consistent blocking of light penetration at variable sun angles and cut down on material quantity.

As illustrated in the embodiment of FIG. 1, each holding plate 104 is connected to housing 106 by at least two clamps 107. Each clamp 107 is suspended from housing 106 by a pin 108 that passes through housing 106 and attaches to a slide bar 111 via a hanging mechanism 112. Housing 106 most preferably houses an alignment mechanism 113 and a spacing mechanism 120 that interact with each sliding bar 111; however, housing 106 can also house only an alignment mechanism or only a spacing mechanism. The alignment mechanism 113 controls the vertical adjustment of the screens relative to one another while the spacing mechanism controls the horizontal adjustment of the screens relative to one another. The alignment mechanism moves the screens of rods up and down relative to one another, maintaining a consistent angle between rod centerlines of all screens as the position of the rods along the vertical y-axis changes. The spacing mechanism moves the screens of rods closer to and further away from one another, maintaining a consistent spacing between the rods of all screens as the spacing between the rods changes along the horizontal x-axis. This vertical and horizontal adjustment positions the rods relative to one another to achieve the light penetration and view transparency desired by the user. The four basic effects that can be achieved by adjusting the rods using both the alignment mechanism and the spacing mechanism together are 1) full view transparency with full light penetration, 2) full view transparency with blocked light penetration, 3) no view transparency with full light penetration, and 4) no view transparency with blocked light penetration, though any point in between these four basic effects can be achieved, for example 60% light penetration and 10% view transparency. For simplicity, we will only discuss the four basic positional effects while recognizing that other effects can be achieved. In a device having only an alignment mechanism, only view can be manipulated; while in a device having only a spacing mechanism, only light penetration can be manipulated.

Figure 3:
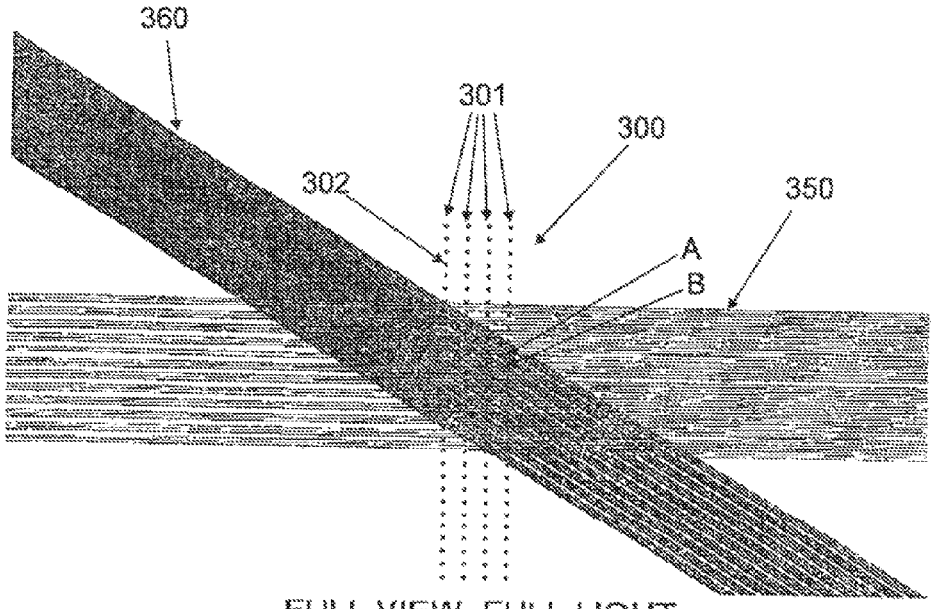
FIG. 3 is a side view of the layered blinds arrangement for full view with full light.
Figure 4:
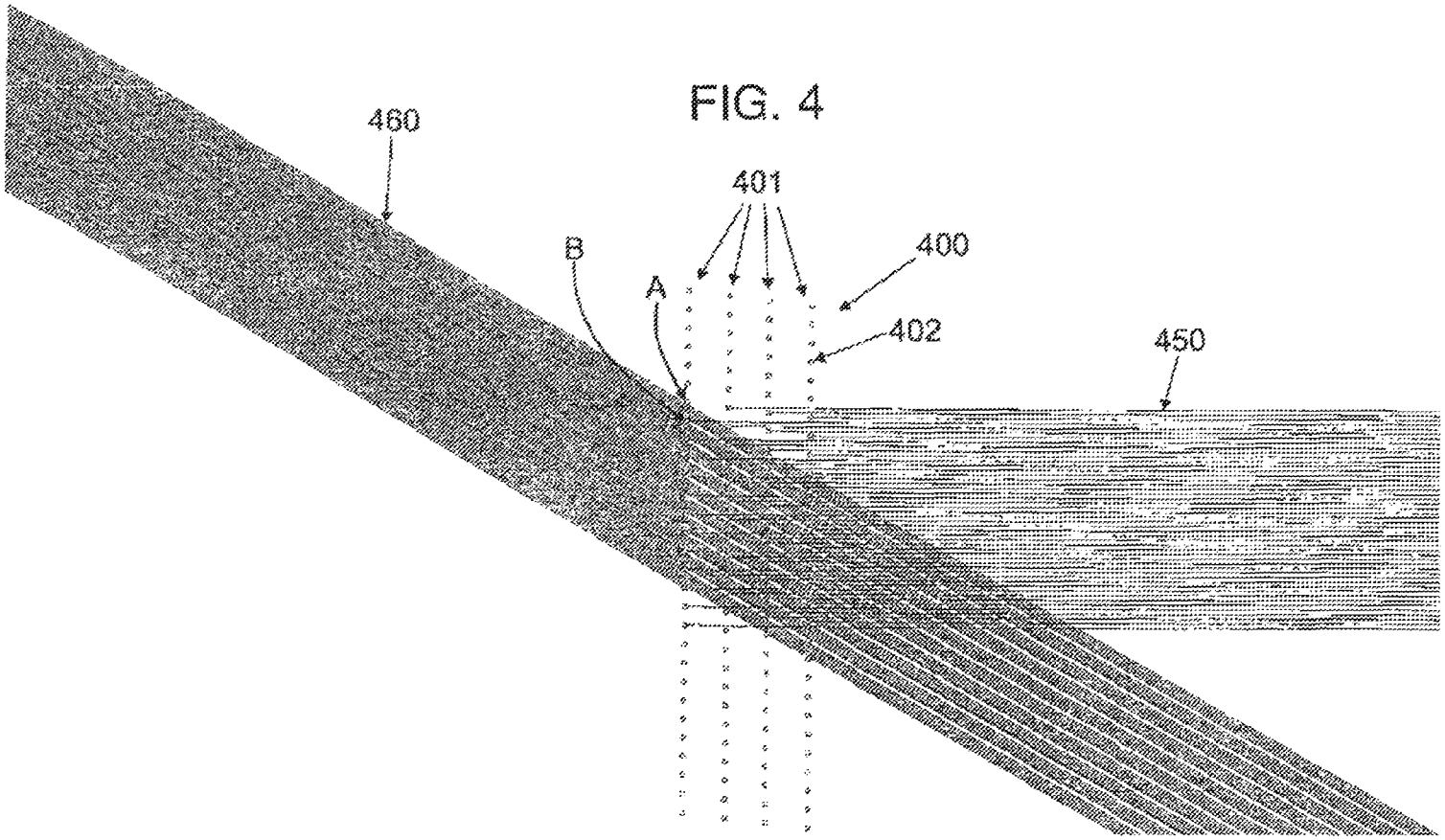
FIG. 4 is a side view of the layered blinds arrangement for full privacy with full light.
Figure 5:
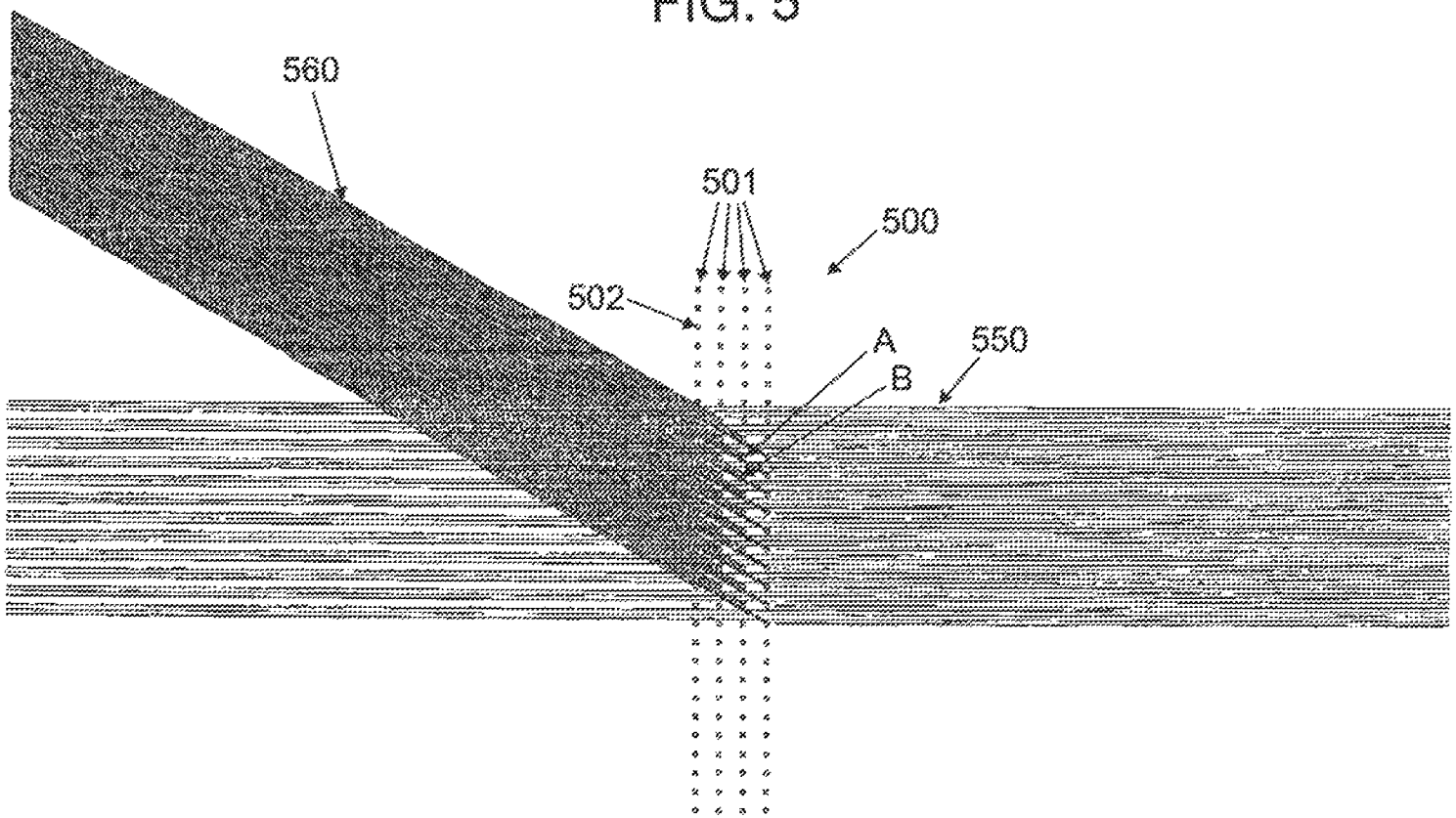
FIG. 5 is a side view of the layered blinds arrangement for full view with full shading.
Figure 6:
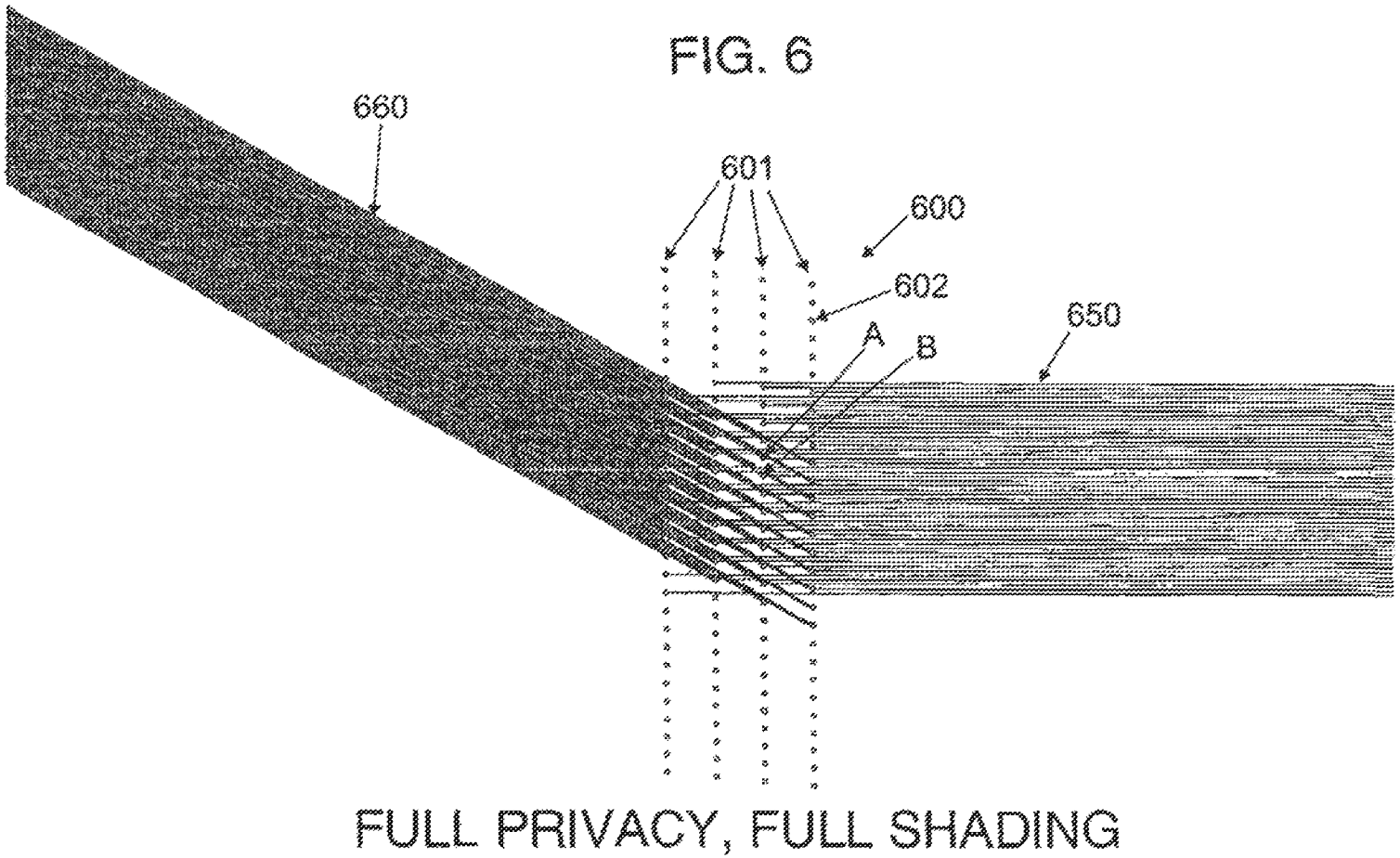
FIG. 6 is a side view of the layered blinds arrangement for full privacy with full shading.

The view available through the device is controlled by the vertical positioning of the rods of each screen relative to the rods of the other screens. As shown in FIGS. 3 and 5, when adjacent pairs of rods A and B of parallel rods 302 and 502 of each screen 301 and 501 are aligned relative to visual angle 350 and 550, full view transparency is achieved. As shown in FIGS. 4 and 6, when the adjacent, parallel rods 402 and 602 are staggered relative to visual angle 450 and 650, respectively, the space between any pair of adjacent rods A and B on any given screen of rods is filled in by the cumulative depth of one rod from each of the remaining three screens and full privacy (i.e. no view penetration) is achieved.

The amount of light passing through the device is controlled by the horizontal positioning of the rods of each screen relative to the rods of the other screens. The exact effect of the position of the rods on light is dependent on the solar angle at which the light is hitting the device. When rods are aligned with each other relative to the solar angle, maximum light is allowed to pass through. The more staggered the rods are relative to the solar angle, the more light is blocked. As shown in FIGS. 3 and 5, when light 360 and 560 is hitting devices 300 and 500, respectively, at a 30° angle, positioning screens 301 and 501 at a given spacing from one another blocks light penetration while positioning screens 301 and 501 at another given spacing provides full light penetration. In order to achieve full shading, the horizontal spacing of the screens 501 must be staggered such that the light 560 passing through the space between any two adjacent pair of rods A and B on one screen is intercepted by the cumulative depth of one rod from each of the remaining screens as shown in FIG. 5. In order to achieve full light penetration, the horizontal spacing of screens 301 must be aligned such that the light 360 passing through any two adjacent rods A and B on one screen has a clear path through the diagonally adjacent rods of each of the remaining three screens as shown in FIG. 3.

The relationship between rods and screens of the device and the effect on light penetration and view transparency is explained by the following formulas:

$$N=J/Q,$$

where, N=number of screens, J=rod spacing, and Q=rod diameter;

$$A = \frac{\left\{ \begin{array}{c} J\tan X + [[(D*Q)\tan X]/\cos Y] - \\ [[(E*Q)\tan Y]/\cos X] \end{array} \right\}}{[\tan X + \tan Y]} * \frac{\{(X+Y)\}}{\mathrm{abs}[(X+Y)]}$$

$$B = \frac{A + [(E*Q)/\cos X]}{\tan X}$$

-continued $$S = \{J[r(A/J)] - A\} - \left\{ J*0.5*\left\{ \frac{[(\mathrm{abs}(J[r(A/J)] - A)) - J/2]]}{[\mathrm{abs}[(\mathrm{abs}(J[r(A/J)] - A)) - J/2]]} + 1 \right\} * \frac{[-A]}{\mathrm{abs}(A)} \right\}$$

abs = absolute value; e.g. abs(−2) = 2 or abs(2) = 2

Figure 10:
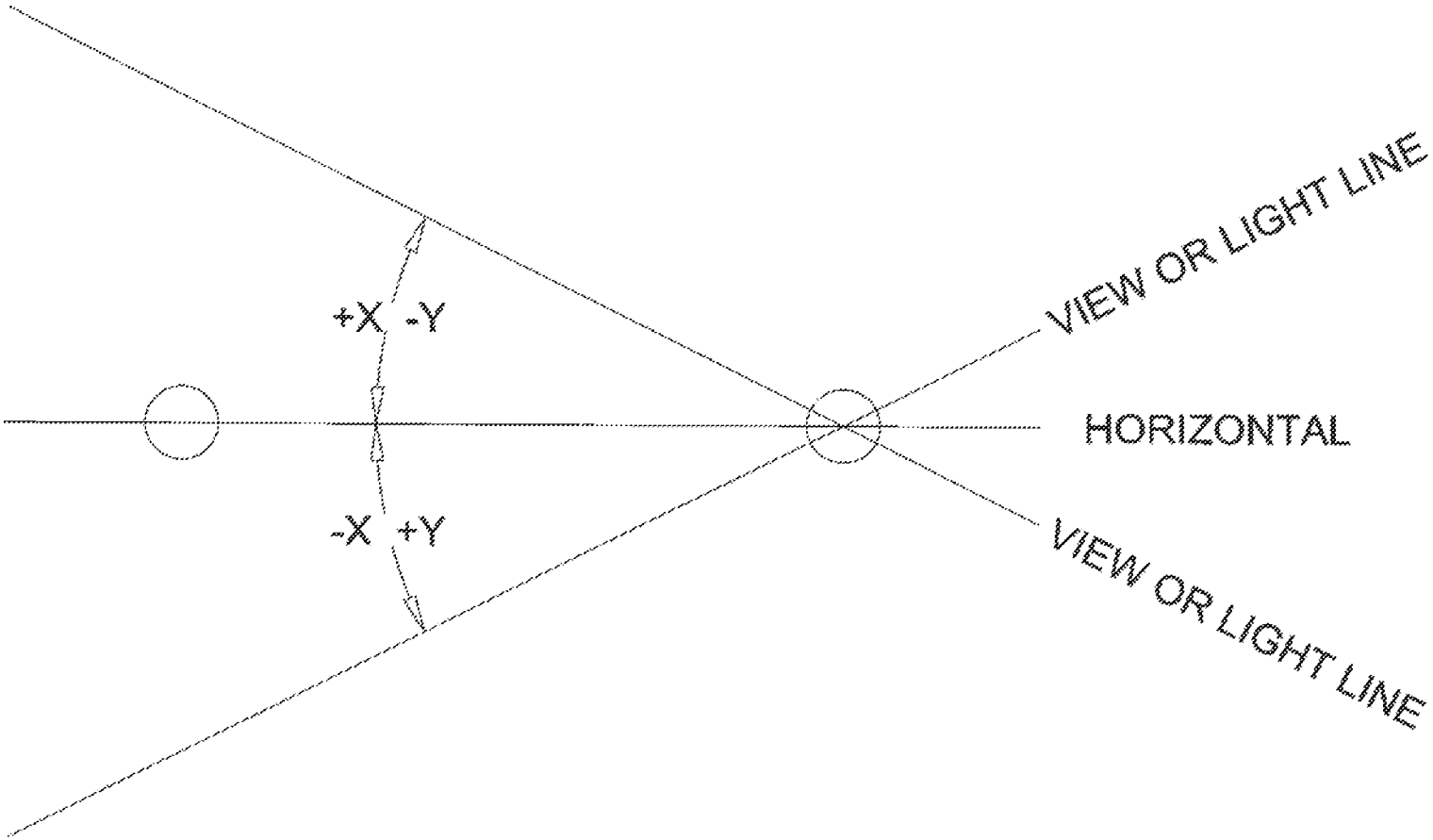
FIG. 10 illustrates how to measure the light angle (X) and the view angle (Y).

$r$ = round towards 0 to the nearest integer including 0;

e.g. $r(.4) = 0$ or $r(1.4) = 1$ where, A=unadjusted vertical offset, B=spacing between screens, S=adjusted vertical offset, J=spacing between rods, Q=rod diameter, X=light angle, Y=view angle, D=view coefficient (from −1 to 1 with 0 being maximum view), and E=light coefficient (from −1 to 1 with 0 being maximum light). As shown in FIG. 10, light angle (X) and view angle (Y) are measured from the horizontal in either the clockwise or counterclockwise direction. View angle (Y) is positive below the horizontal plane and negative above the horizontal plane with a preferred range of about +90 to −90 degrees; while light angle (X) is positive above the horizontal plane and negative below the horizontal plane with a preferred range of about +90 to −90 degrees.

Figure 7A:
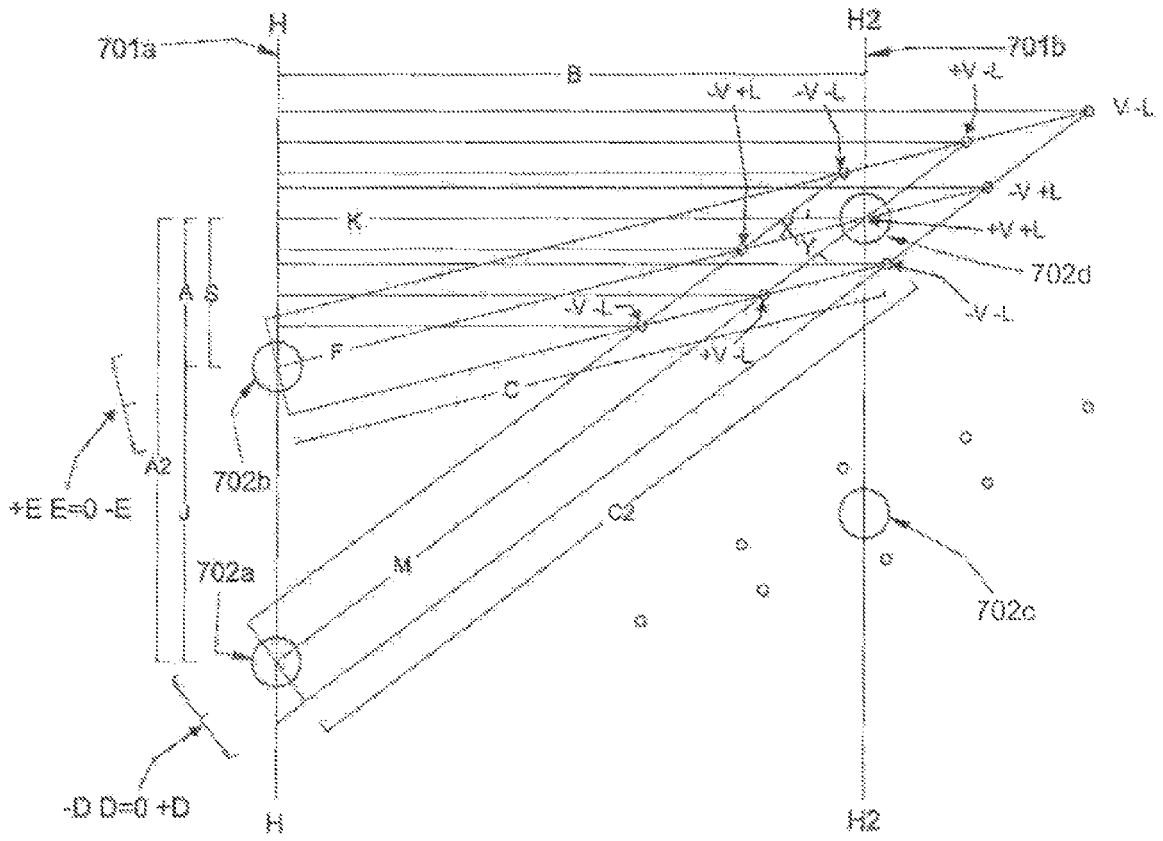
FIGS. 7A-7L are side views illustrating the geometric relationship between solar angle, desired light penetration, desired degree of privacy, rod spacing and screen spacing of the present invention.
Figure 7B:
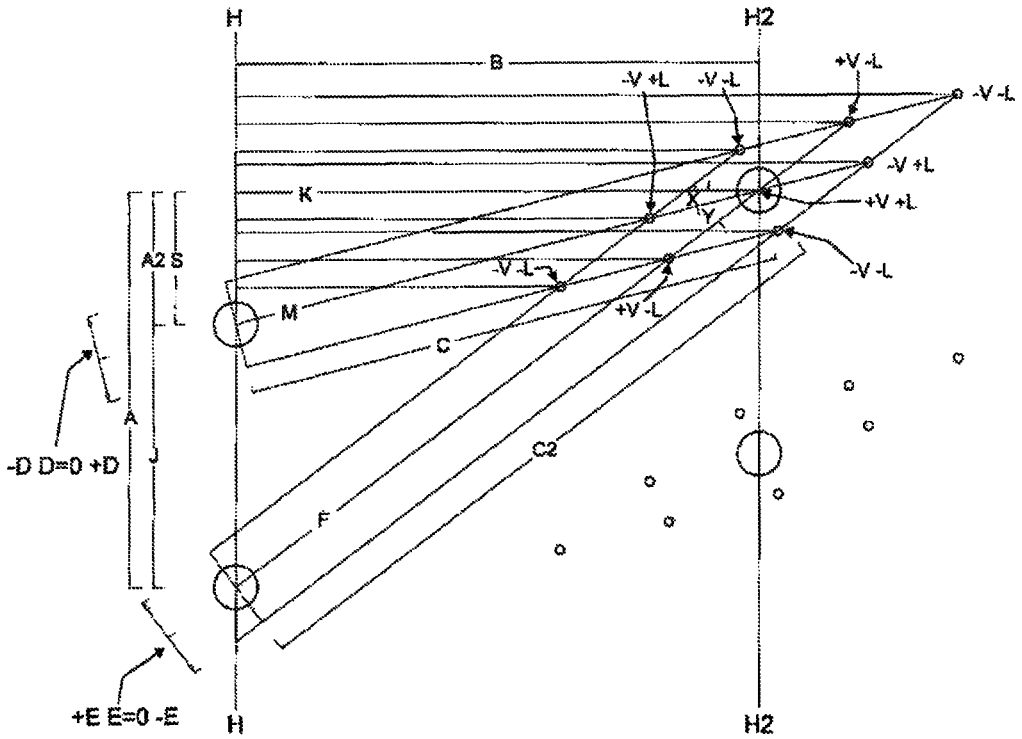
Figure 7C:
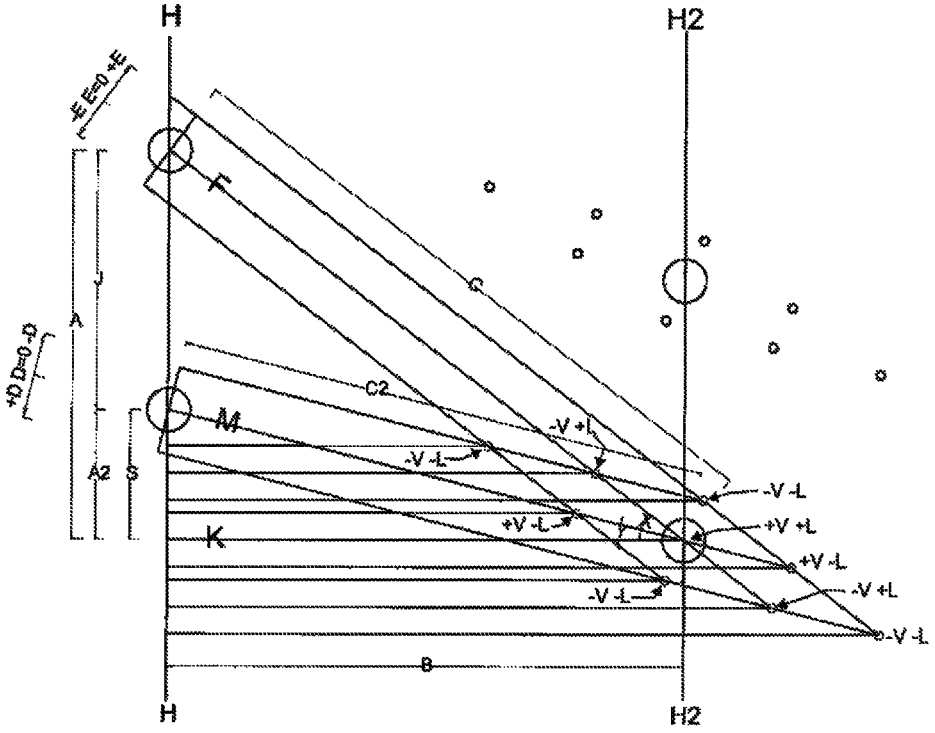
Figure 7D:
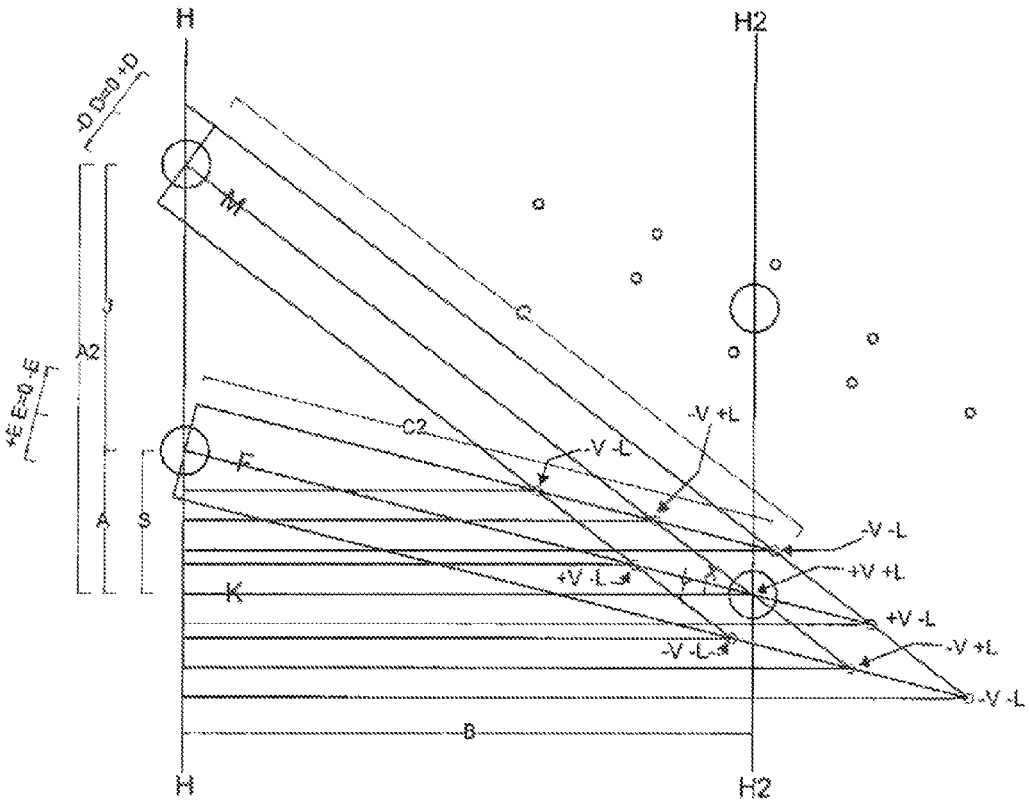
Figure 7E:
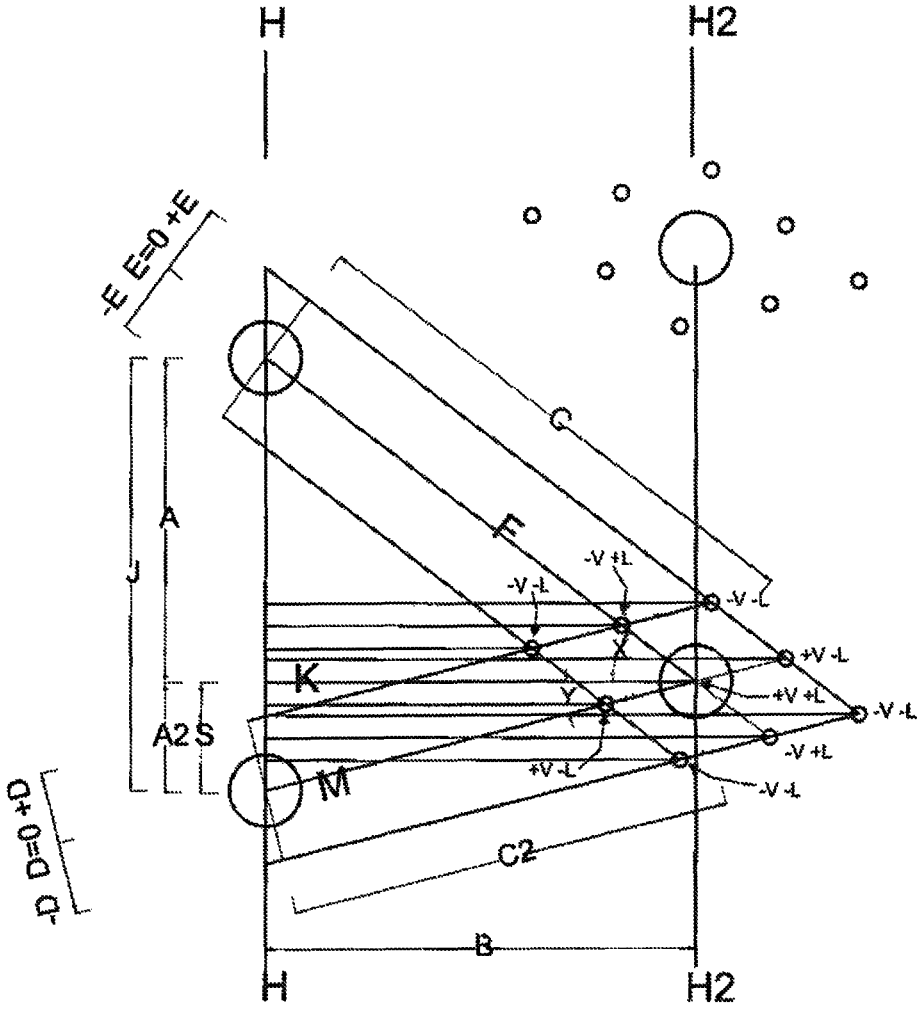
Figure 7F:
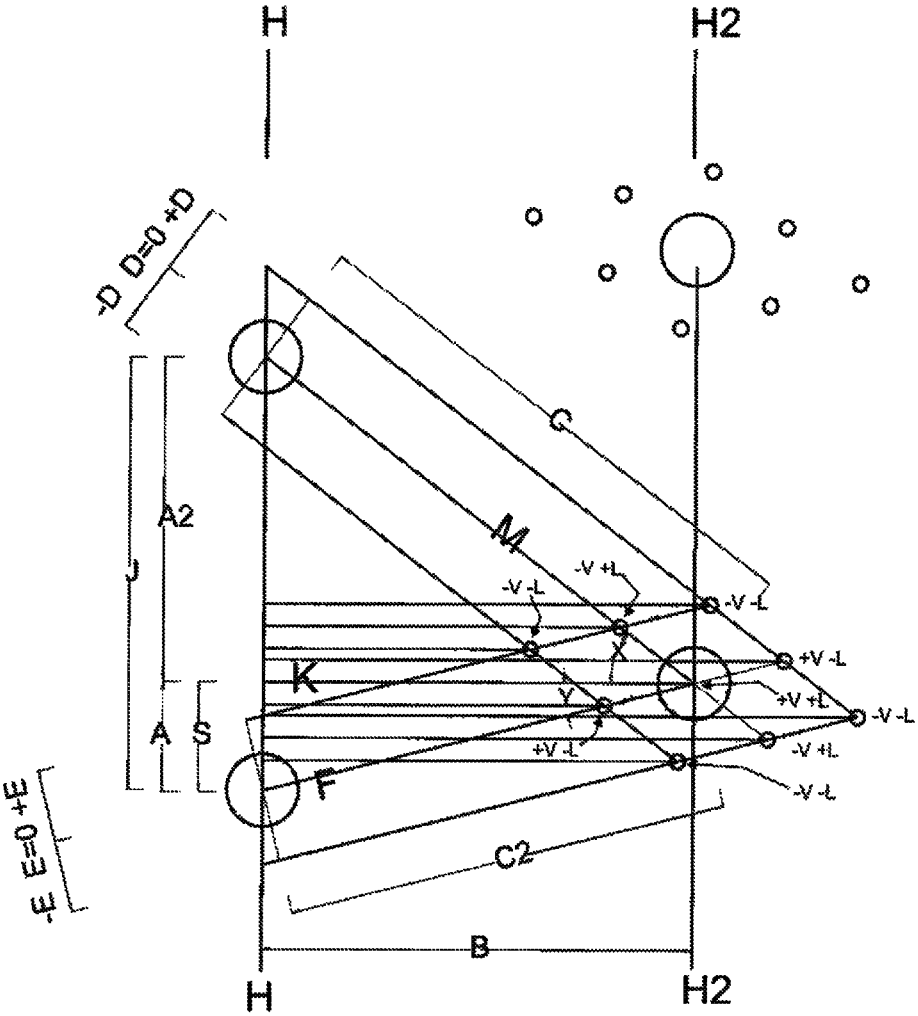
Figure 7G:
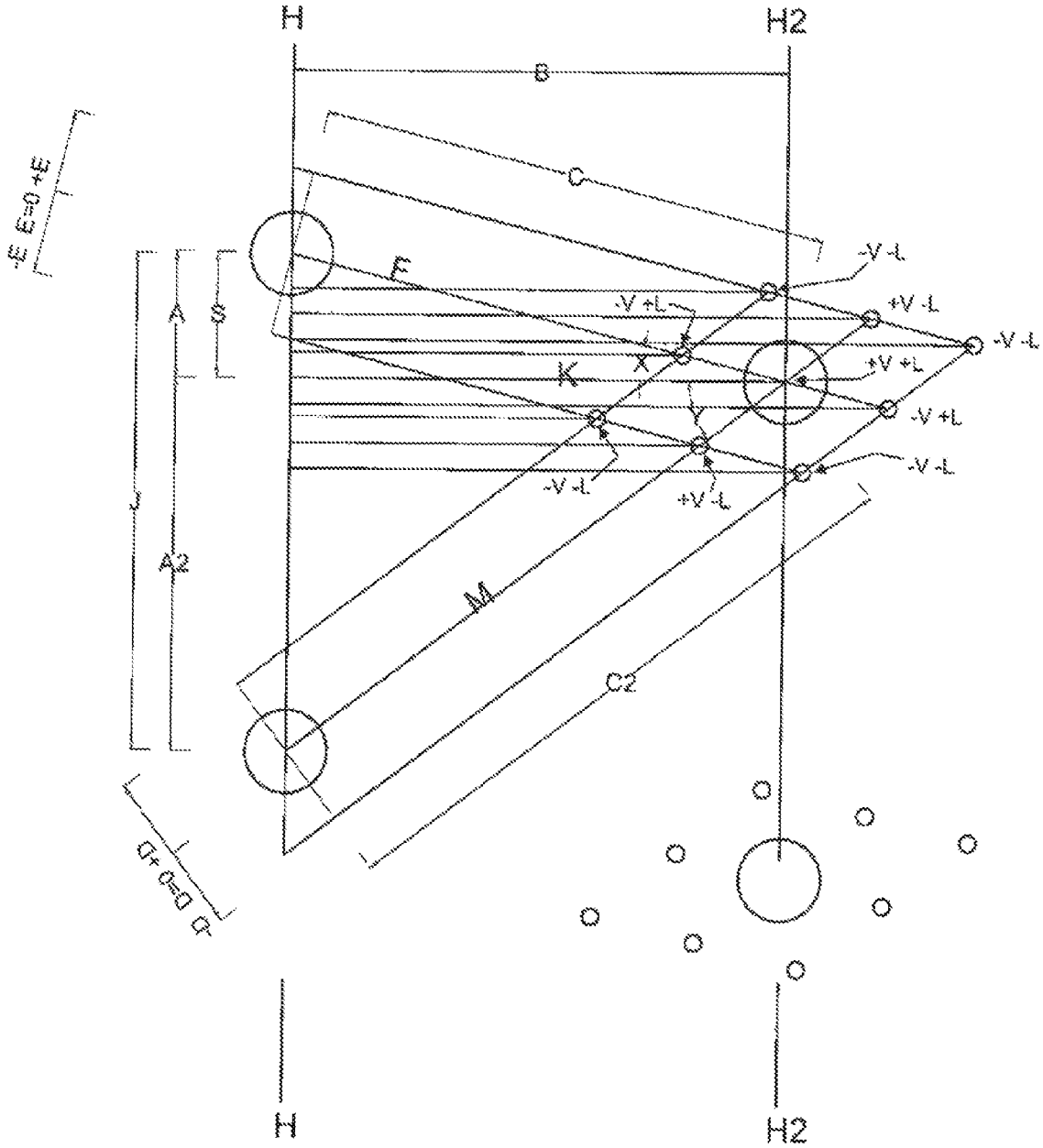
Figure 7H:
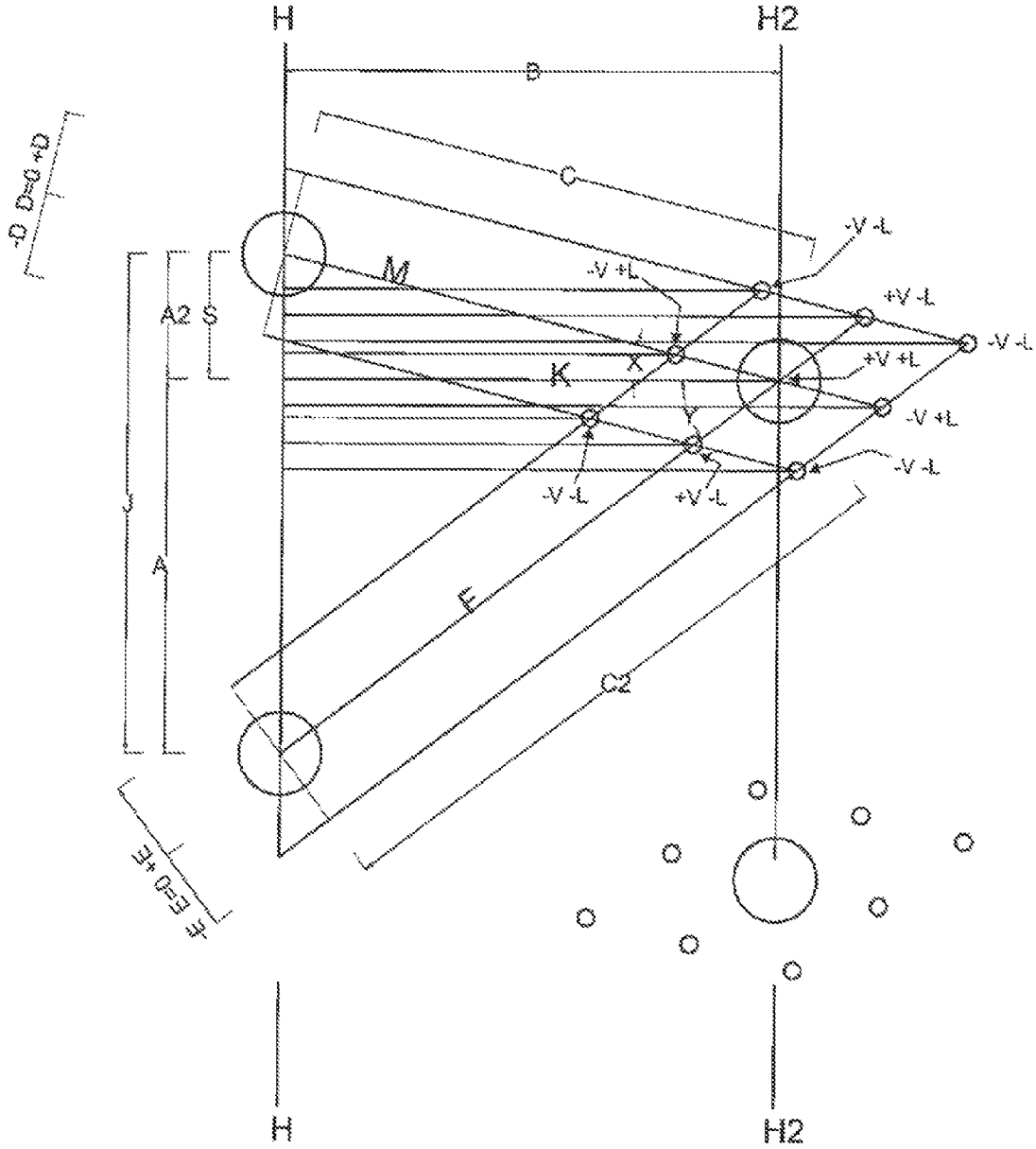
Figure 7I:
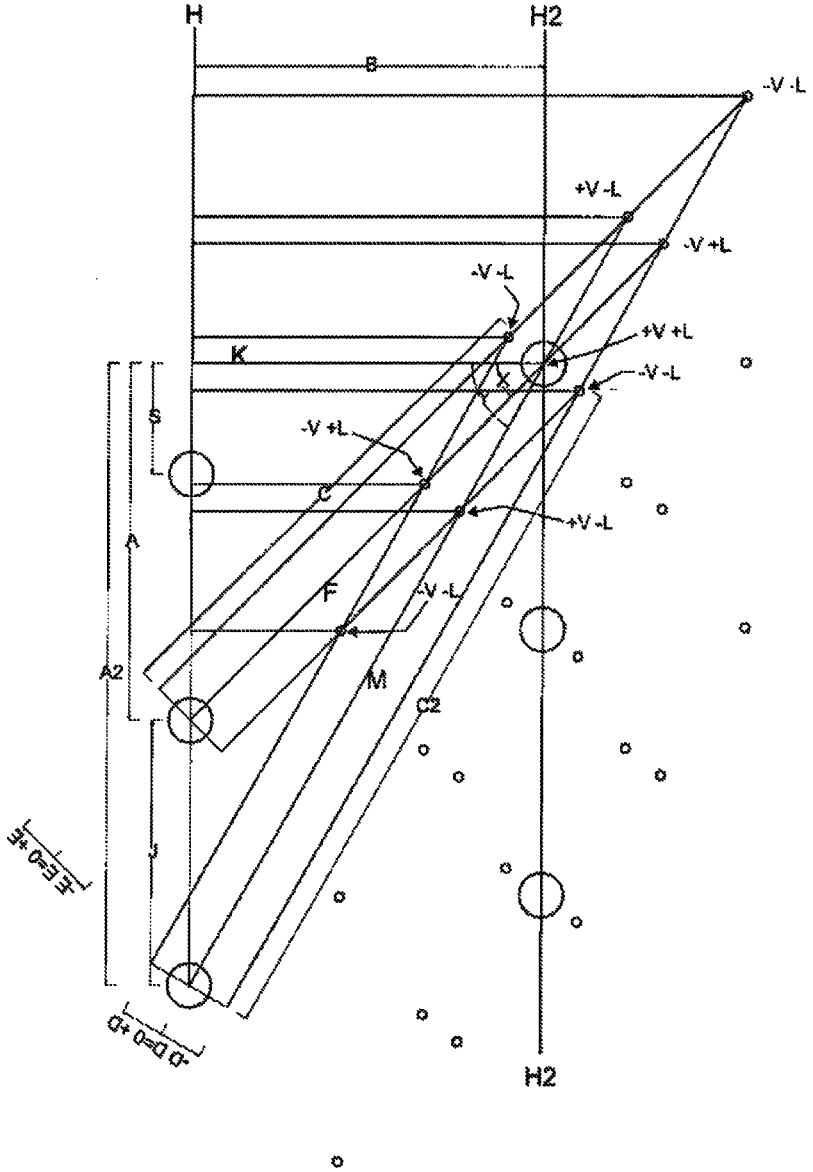
Figure 7J:
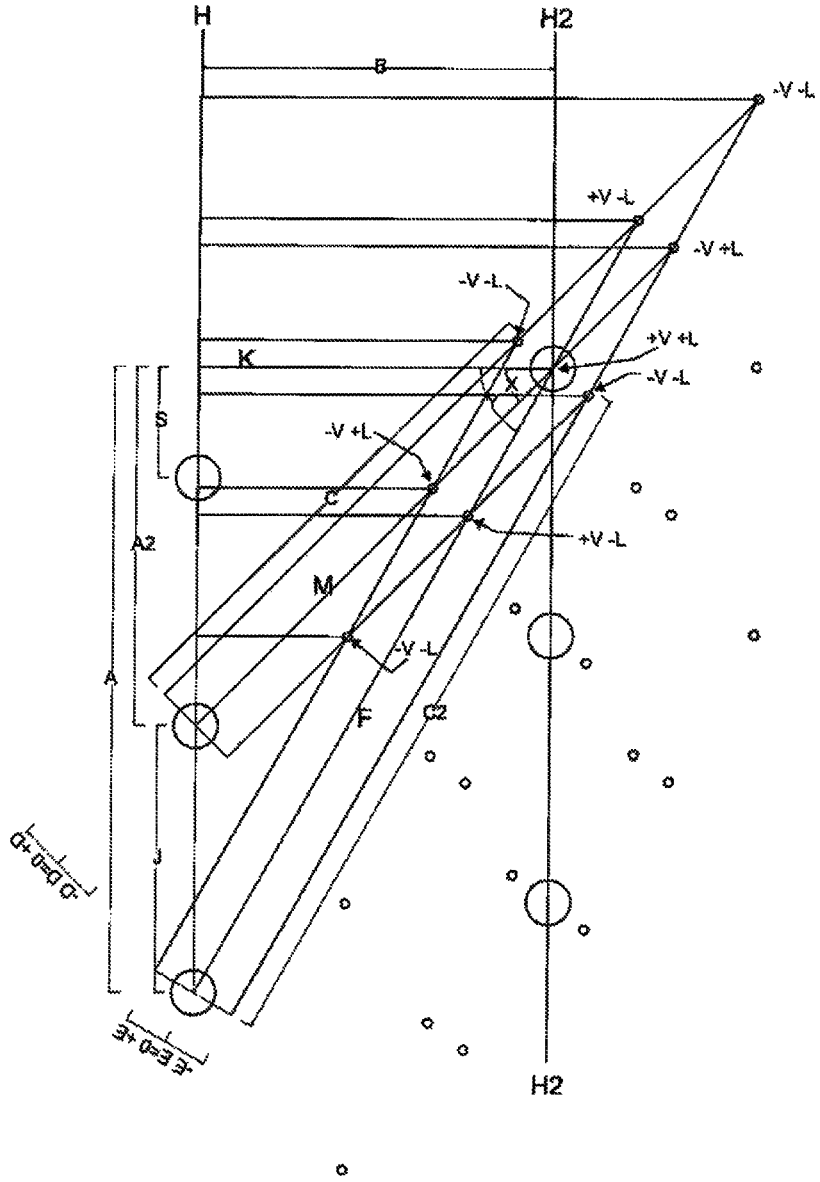
Figure 7K:
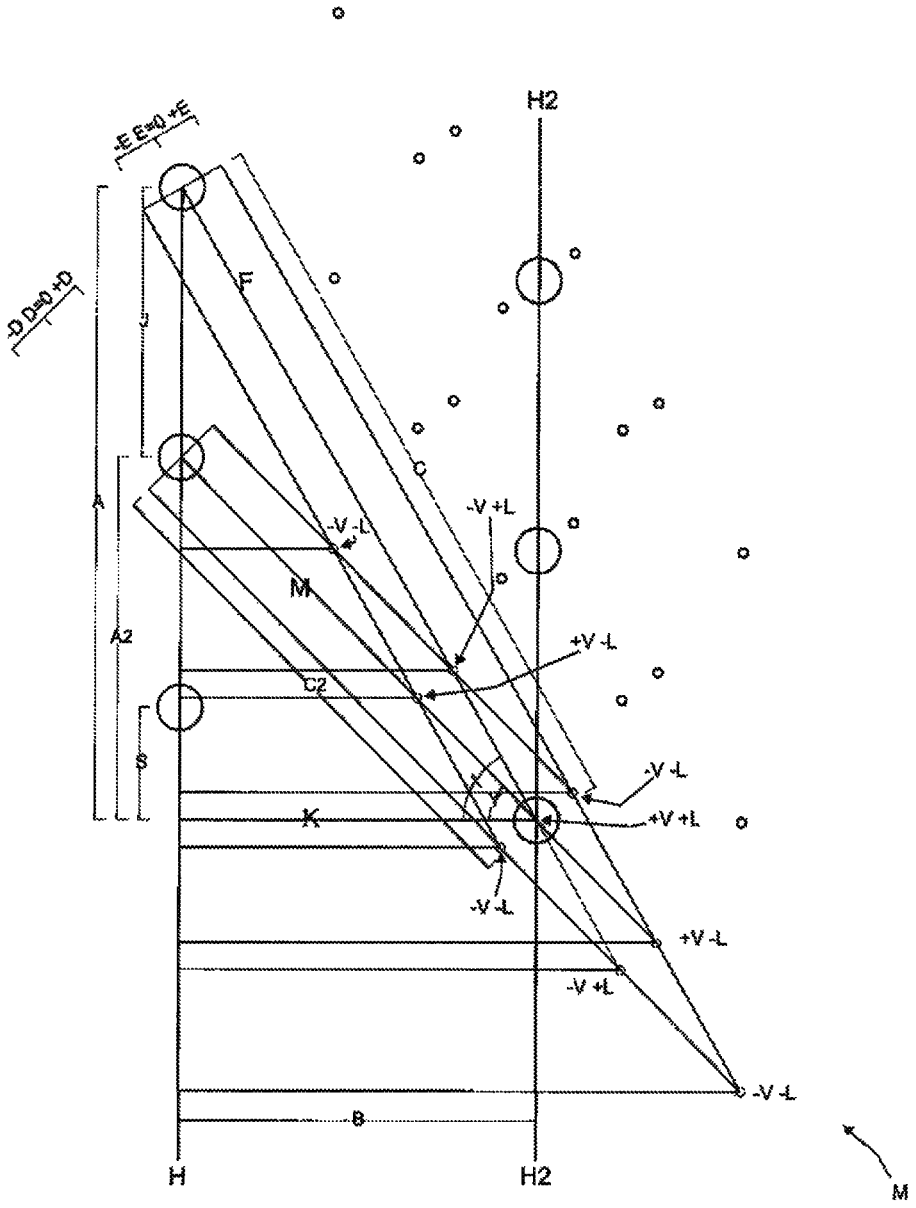
Figure 7L:
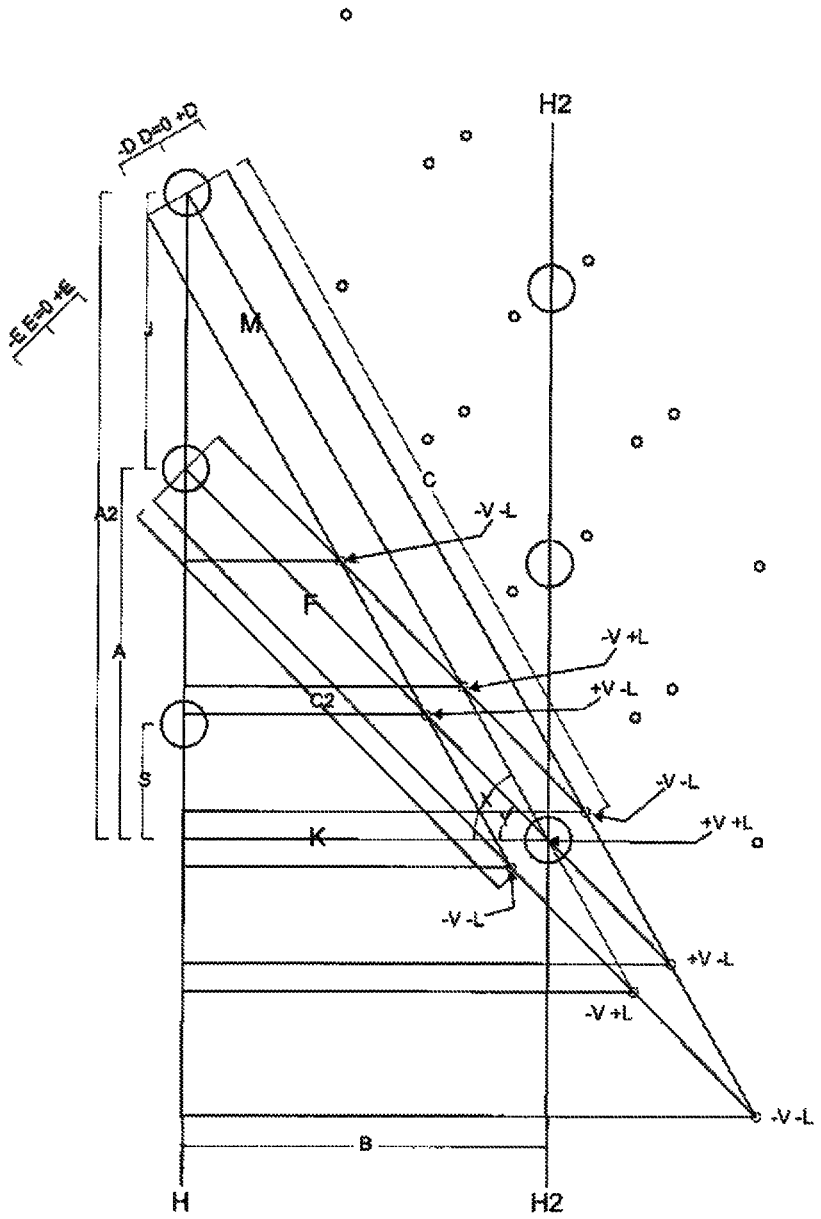

The relationship of the variables is set forth in FIGS. 7A-7L. FIGS. 7A-7L illustrates the geometric relation between the rods, screens, light, and view as seen from a side view of two representative screens. Each of FIGS. 7A-7L shows the relationship at a different view and light angle combination. For simplicity, FIG. 7A will be discussed in detail herein, but the principles apply to all of FIGS. 7A-7L. In FIG. 7A, rods 702*a* and 702*b* make up a portion of representative screen 701*a* while rods 702*c* and 702*d* make up a portion of representative screen 701*b*. The distance J represents the spacing between rods measured from the center of one rod to the center of an adjacent rod of the same screen; while the distance B represents the spacing between screens 701*a* and 701*b* measured from the center of one screen's rod to the center of the other screen's rod. For the purposes of FIG. 7A, screen 701*a* remains stationary while screen 701*b* moves closer or further away relative to screen 701*a*. In function, one screen may remain stationary or all screens can move. The vertical plane of each screen intersects a level line of vision at a 90° angle. In order to provide maximum view transparency and light penetration at a particular solar angle X and a particular view angle Y, rod 702*d* is aligned with rod 702*a* along line M (the view line) and with 702*b* along line F (the light line). Lines H (the screen line) and K (the base line) form right triangles with lines M and F, thus the geometric principles of right triangles apply, namely sin(x)=opposite/hypotenuse, cos(x)=adjacent/hypotenuse, and tan(x)=opposite/adjacent. In the present invention, X is the solar angle measured from the horizontal plane, Y is the view angle measured from the horizontal plane, B is the length of the adjacent side, A and A2 are the lengths of the opposite sides, C and C2 are the lengths of the hypotenuses and S is the adjusted vertical offset between rods of adjacent screens; therefore, given any solar angle and any view angle, the adjusted vertical offset between rods of adjacent screens, or the value of S, and the screen spacing, or the value of B, can be determined by the above equations. As the solar and view angles increase, the distance required between the screens to block or permit light and view decreases. Given that most window frames have a limited space in which to house blinds, the diameter of the rods, Q, is limited so that the spacing B between the rods does not exceed the functional space of the window frame.

As can be seen from FIG. 7A, if screen 701*b* is moved up or down relative to screen 701*a*, all rods are moved up or down respectively. Similarly, if screen 701*b* is moved left or right, all rods move left or right with the screen. Using rod 702*d* as a representative rod to show the effects of screen movement, the following holds true: If rod 702*d* remains stationary at point +V+L, rod 702*d* is aligned with lines F and M, thus allowing light penetration (+L) and view transparency (+V). If rod 702*d* is moved horizontally and/or vertically to points labeled −V−L, rod 702*d* is misaligned with lines F and M, thus blocking both light penetration (−L) and view transparency (−V) . If rod 702*d* is moved horizontally and/or vertically to points labeled +V−L, the rod is still aligned with line M but misaligned with line F, thus blocking light penetration (−L) but not view transparency (+V) . If rod 702*d* is moved horizontally and/or vertically to points labeled −V+L, the rod is aligned with line F but misaligned with line M thus blocking view transparency (−V) but not light penetration (+L). As set forth in the formula above, the exact distance that a screen must be horizontally moved in order to manipulate light penetration depends on the solar angle, the view angle, the rod diameter, the spacing between the rods, the light coefficient (E) and the view coefficient (D). The view coefficient and light coefficient change independently from one another.

Figure 8:
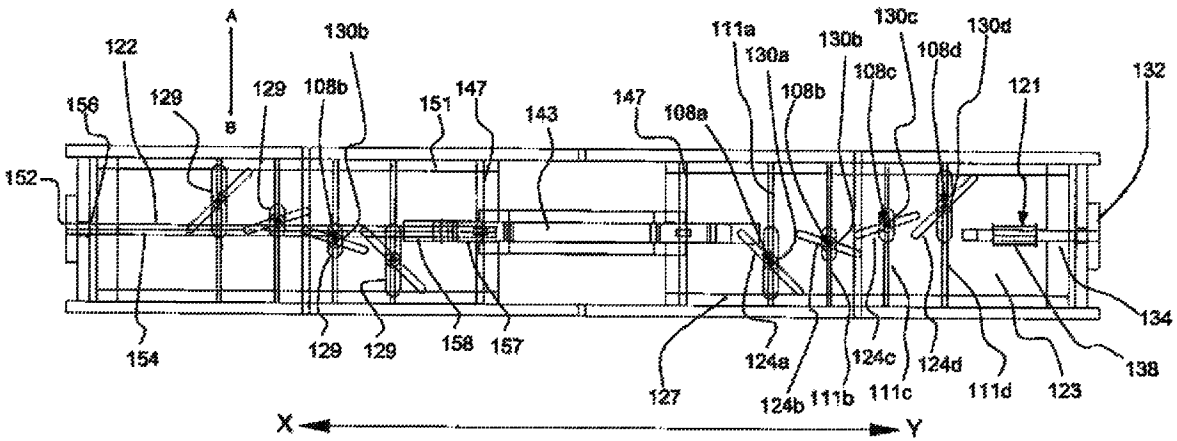
FIG. 8 is a top view of the layered blinds device showing the spacing mechanism.

While the screens of the present device could be controlled by a variety of movement mechanisms, the screens are preferably controlled by at least one manual engagement mechanism or by a tracking system. An embodiment having two manual engagement mechanisms 121 and 122 are shown in FIG. 1, FIG. 2 and FIG. 8. In this embodiment, engagement mechanism 121 engages spacing mechanism 120 which controls the horizontal spacing of the screens relative to one another while engagement mechanism 122 engages alignment mechanism 113 which controls vertical alignment of the screens relative to one another.

As illustrated in FIG. 2 and FIG. 8, spacing mechanism 120 includes slide bars 111*a*, 111*b*, 111*c*, and 111*d*, a sliding platform 123 having sliding guides 124*a*, 124*b*, 124*c*, and 124*d*, and at least one stationary platform 125 on either side of sliding platform 123 having stationary guides 129. There is preferably one pair of slide bars and one pair of sliding guides for each screen. Slide bars 111*a*, 111*b*, 111*c*, and 111*d*, and sliding guides 124*a*, 124*b*, 124*c*, and 124*d* correspond to a first, second, third, and fourth screen respectively. As shown in FIG. 1 and FIG. 2, pins 108 are attached at one end to slide bar 111 via hanging mechanisms 112 and at the other end to a screen 101 via clamping mechanisms 107. As shown in FIG. 8, pins 108*a*-108*d* hang through stationary guides 129 and sliding guides 124*a*-124*d*. Specifically, each of pins 108*a*-108*d* pass through a tube with rolling bearings and these tubes 130*a*-130*d*, in turn, pass through the stationary and sliding guides. The pins move up and down within the tubes while the tubes remain in a fixed position. While it is understood that the pins move via the tube and roller bearing mechanism, for simplicity, we will simply discuss the movement of the pins. Engagement mechanism 122 preferably includes a knob 132 attached to a threaded bolt 134 by at least one nut 136. Bolt 134 extends into a threaded opening 138 in one end of sliding platform 123.

As knob 132 is turned, bolt 134 moves within opening 138 thereby engaging sliding platform 123 into motion horizontally along line XY as shown in FIG. 8. As sliding platform 123 slides horizontally, sliding guides 124*a*-124*d* push respective pins 108*a*-108*d* along their respective sliding bars 111*a*-111*d* either further from or closer to the center point of each respective sliding bar. Each pair of sliding guides 124*a*-124*d* is positioned at a unique angle relative to the slide bars 111*a*-111*d*. This angling maintains consistent spacing between the screens as they are horizontally adjusted. The length of each sliding guide 124*a*-124*d* corresponds to the range of movement allowed for a particular pin, and hence for a particular screen. Sliding guides a 124*a* and 124*d* are longest and thus pins 108*a* and 108*d* have the greatest range of motion and correspond to the exterior screens of the device. Sliding guides 124*b* and 124*c* are the shortest and thus pins 108*b* and 108*c* have the smallest range of motion and correspond to the interior screens of the device. Stationary guides 129 allow for movement of the pins through the stationary platforms and ensure that this movement is uniformly linear, perpendicular to the long axis of the platforms.

As can be seen in the embodiment of FIG. 1, alignment mechanism 113 includes pivot bars 150, a pair of pivot platforms 151 and a sliding plate 143. Each pivot platform 151 has a first end and a second end and a first side and second side. Pivot bars 150 extend through pivot platforms 151 from the first side to the second side at about the center point. Slide bars 111 also extend through and are supported by pivot platforms 151 from the first side to the second side. There are preferably four slide bars extending through each pivot platform. As discussed previously, pins 108 hang from sliding bars 111 via hanging mechanisms 112 at one end and hold screens 101 via clamps 107 at the other end.

As illustrated in FIG. 1, sliding plate 143 of alignment mechanism 113 is supported vertically within housing 106. Plate 143 includes plate guides 144 through each of which a plate bar 147 passes and connects to the first end of an adjacent pivot platform 151. Engagement mechanism 122 of alignment mechanism 113 preferably includes a knob 152 attached to a threaded bolt 154 by at least one nut 156. Bolt 154 extends into opening 157 via a threaded receiver 158 in one end of sliding plate 143.

As knob 152 is turned, bolt 154 rotates within opening 157 thereby engaging sliding plate 143 into motion horizontally along line XY as shown in FIG. 1. As bolt 154 rotates in opening 157, sliding plate 143 slides horizontally along bolt 154 and plate bars 147 move along plate guides 144. Plate guides 144 are positioned at an angle within sliding plate 143, and, accordingly, plate bars 147 move either up or down the guide angle depending on the direction of movement of the sliding plate. As plate bars 147 climb the angled guide, they lift the first end of the respective pivot platform 151 to which they are attached. As the first end of each pivot platform 151 is lifted, each pivot platform 151 pivots around the respective plate bar 147 such that each pivot platform 151 is now positioned diagonally with the first end of each pivot platform and the pins 108 located closer to the first end being in a higher position. As each pair of pins is connected to one screen, the position of each screen relative to one another changes with the lifting of the first end of the pivot platforms. As the sliding plate is pushed away from the bolt, the plate bar moves down the angled guide thus lowering the first end of the pivot platform and, consequently, the pins located closer to the first end are moved to a lower position. This changing of screen positions changes the alignment of the rods and thus changes the view. While the alignment mechanism described is a preferred mechanism, other mechanisms that change the screen positions relative to one another could be used.

Figure 11:
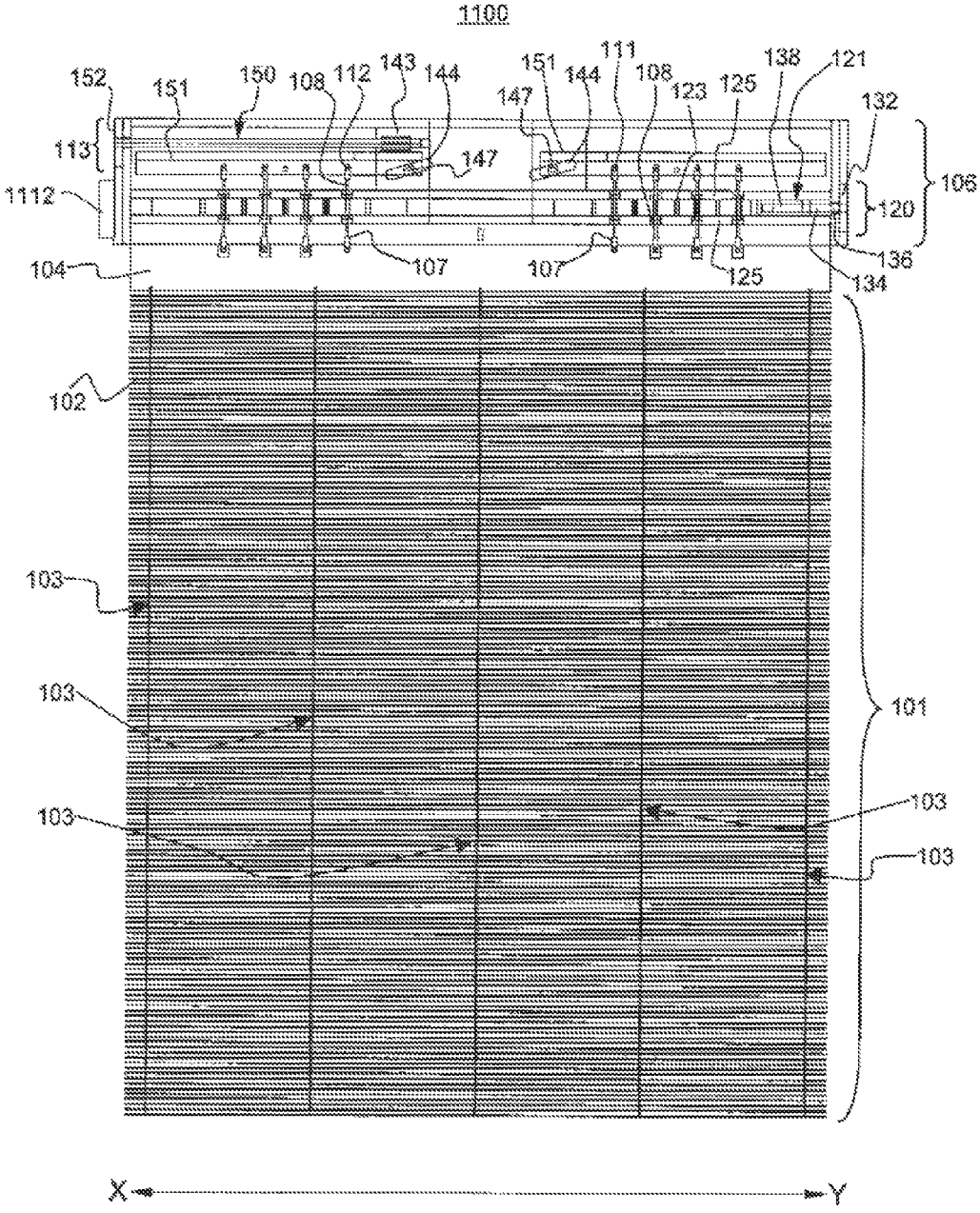
FIG. 11 is a frontal view of layered blinds with a tracking system, shown schematically, in accordance with an embodiment of the present invention.
Figure 12:
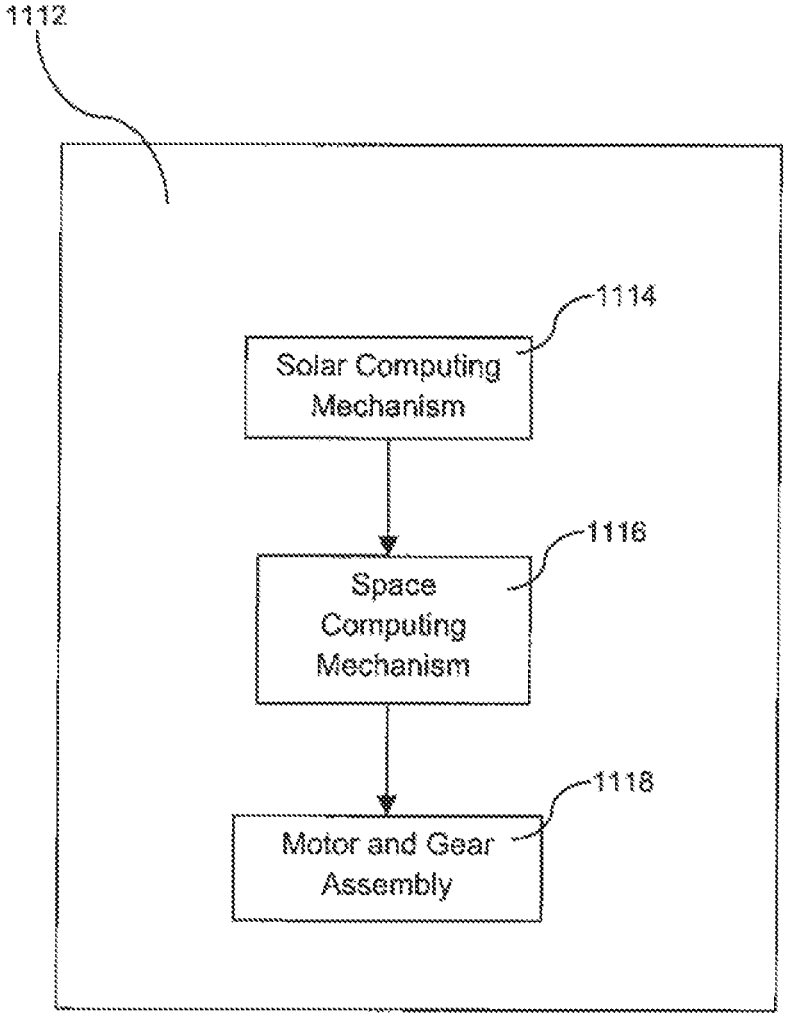
FIG. 12 is schematic view of the tracking system of FIG. 11.
Figure 13:
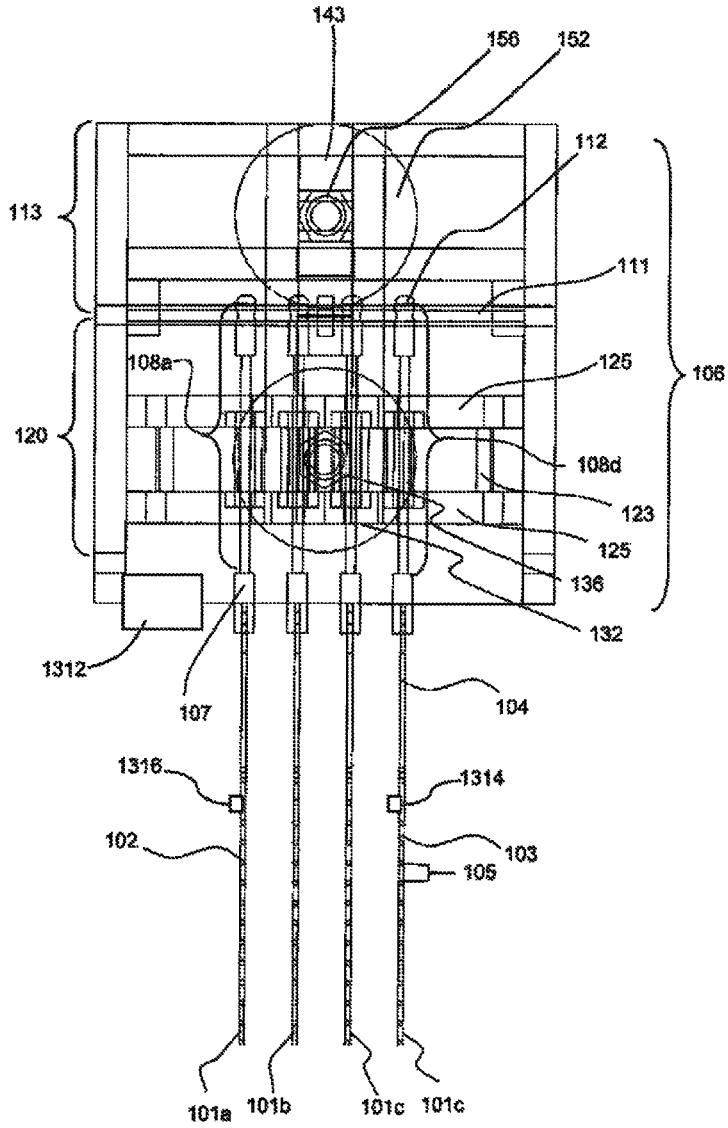
FIG. 13 is a side view of layered blinds with a photovoltaic powered tracking system, shown schematically, in accordance with an embodiment of the present invention.
Figure 14:
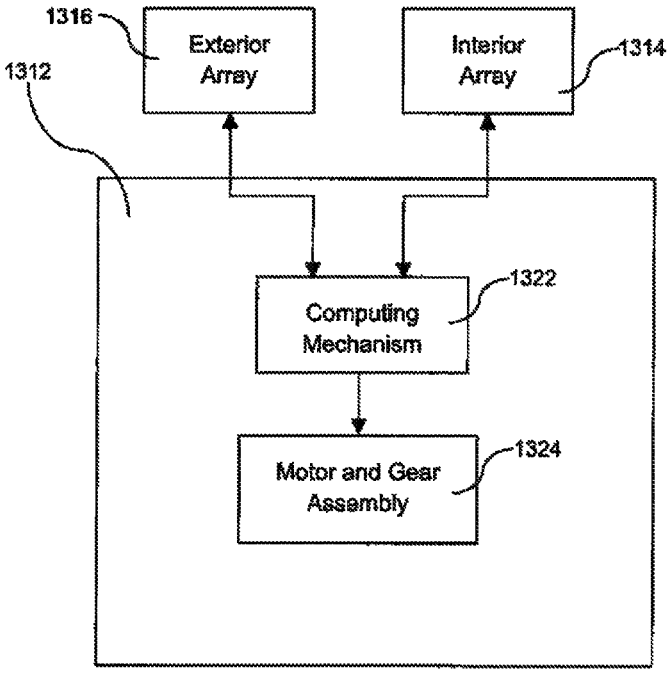
FIG. 14 is schematic view of the tracking system of FIG. 13.

While the embodiments discussed above are manually controlled devices, the layered blinds of the present invention can also be controlled by a tracking system that tracks the movement of the sun to maintain set levels of light and transparency. FIGS. 11 and 12 show a device 1100 of the present invention including a tracking system 1112 employing a solar computing mechanism 1114 that calculates the sun's position for a given latitude and longitude as it changes over the course of a day and over the course of many years. Computer generated solar position calculations yield solar angle values (X). A space computing mechanism 1116 runs this value through the equations discussed previously, namely $$A = \frac{\left\{ \begin{array}{c} J\tan X + [[(D*Q)\tan X]/\cos Y] - \\ [[(E*Q)\tan Y]/\cos X] \end{array} \right\}}{[\tan X + \tan Y]} * \frac{\{(X+Y)\}}{\mathrm{abs}[(X+Y)]}$$

$$B = \frac{A + [(E*Q)/\cos X]}{\tan X}$$

$$S = \{J[r(A/J)] - A\} - \left\{J*0.5*\left\{\frac{[(\mathrm{abs}(J[r(A/J)] - A)) - J/2]]}{[\mathrm{abs}[(\mathrm{abs}(J[r(A/J)] - A)) - J/2]]} + 1\right\}*\frac{[-A]}{\mathrm{abs}(A)}\right\}$$

with view angle and light and view preference values included and adjusts screen spacing via an electric motor and gear assembly 1118. FIGS. 13 and 14 illustrate an embodiment of tracking system 1312 that employs two small photovoltaic arrays. One array 1314 is mounted on one of the rods of the screen most interior to the room in which it is placed. The other array 1316 is mounted on one of the rods of the screen most exterior to the room. Relative to one another, the arrays generate differing amounts current depending on how much the inner array is shaded by rods closer to the window/sunlight. A simple computing mechanism 1322 translates the discrepancy in current levels, cross references them with the light and view preference values of the user and adjusts screen spacing via an electric motor and gear assembly 1324.

The layered blinds of the present invention allow users to control light penetration and view transparency as independent variables by exploiting the difference between solar angle and visual angle. Additionally, the present invention also permits air flow through the blinds while managing the light and view. The same principles that apply to horizontally oriented screens/rods also apply to vertically or diagonally oriented screens/rods; however, the housing mechanism would differ. The blinds of the present device can be used in residences as well as larger buildings. The present invention not only allows for unique and desirable lighting and viewing manipulation but also can decrease solar heat gain in the summer and improve passive heating during the winter as a result of the light manipulation.

As shown in FIG. 15, in one embodiment, a device of 1500 of the present invention includes a plurality of screens 1501 comprised of a plurality of vertical rods 1502. Ends (not shown) of rods 1502 of each screen 1501 are held vertically by a track mechanism 1510 similar to the type of track mechanism used in the embodiment of the present invention employing horizontal blinds. Track mechanism 1510 allows vertical rods 1502 for each screen to be moved along two perpendicular axes.

As shown in FIG. 16, in one embodiment, a device 1600 of the present invention includes a plurality of screens 1601 comprised of a plurality of rods 1602. Rods 1602 are oriented diagonally. Device 1600 functions similarly to device 100 of FIG. 1.

Figure 17:
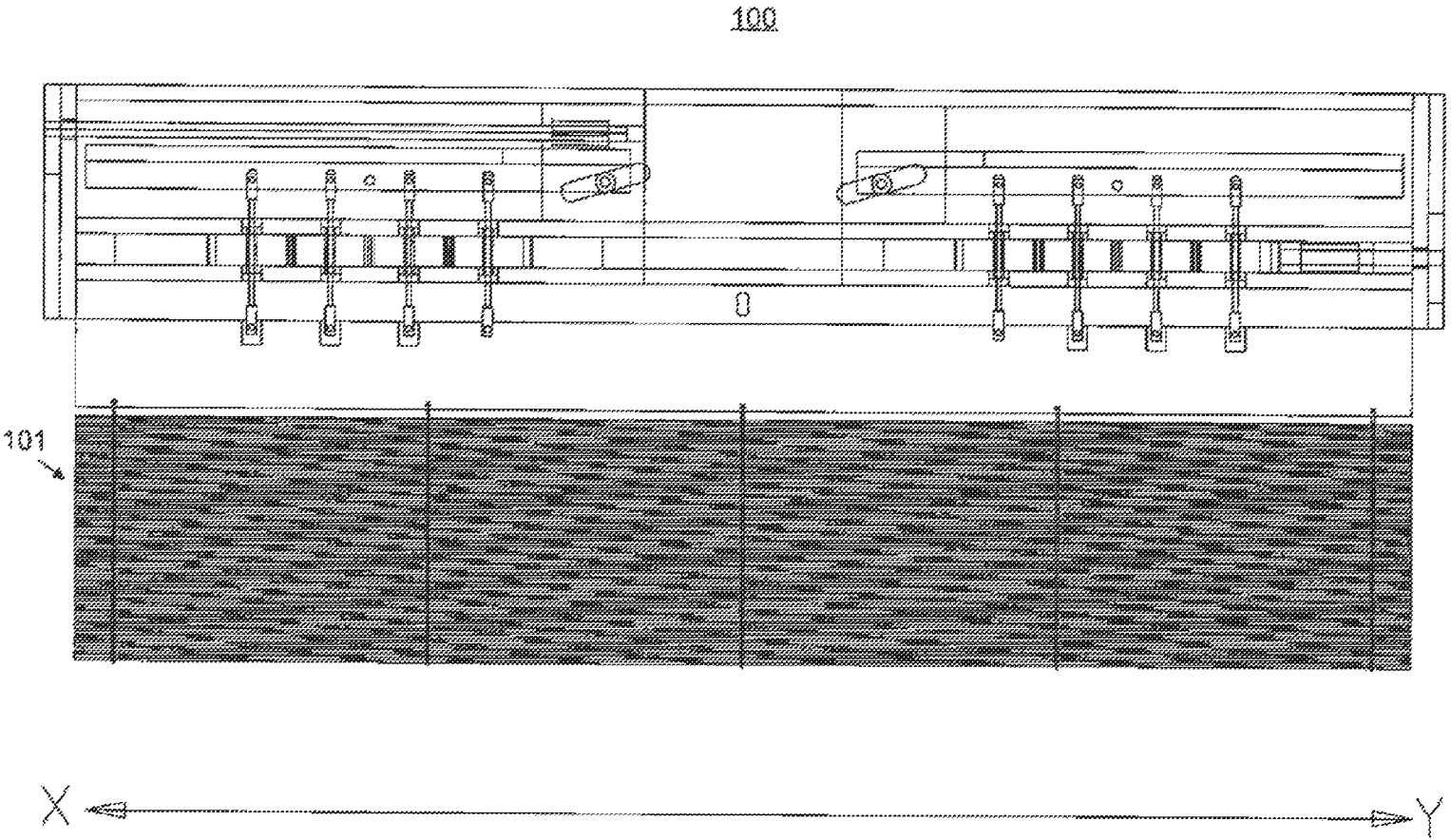
FIG. 17 shows the layer blinds of FIG. 1 in a retracted position.

FIG. 17 shows device 100 in which each screen 101 is in a retracted position.

All documents, patents, journal articles and other materials cited in the present application are hereby incorporated by reference.

Although the present invention has been fully described in conjunction with several embodiments thereof with reference to the accompanying drawings, it is to be understood that various changes and modifications may be apparent to those skilled in the art. Such changes and modifications are to be understood as included within the scope of the present invention as defined by the appended claims, unless they depart therefrom.

What is claimed is:

1. A blinds device for covering a window, comprising:

a plurality of parallel translating screens, each translating screen being disposed within a plane, the plane of each translating screen being substantially parallel to the planes of the other translating screens, the planes of each translating screen being substantially parallel to a plane defined by the window, each of said translating screens being composed of substantially opaque material;

each of said translating screens comprising light-permitting regions disposed on the translating screen, wherein a ratio of the light-permitting regions to the substantially opaque material, located between the light permitting regions, for a particular translating screen is proportional to a number of translating screens in the plurality of parallel translating screens to independently manipulate light penetration and view transparency through the blinds device;

each of said translating screens being separated by a spacing from each adjacent translating screen of said plurality of parallel translating screens; a spacing mechanism for adjusting the spacing between the parallel translating screens in a frist direction, the first direction being normal to the plane of each parallel translating screen;

an alignment mechanism for adjusting an alignment of the light-permitting regions of each of the translating screens relative to the light-permitting regions of the other translating screens in a second direction, the second direction being at a substantially right angle to the first direction;

the spacing mechanism being adapted to uniformly adjust the spacing between the translating screens in the first direction without altering the alignment of the light-permitting regions of each translating screen relative to the light-permitting regions of the other translating screens; and the alignment mechanism being adapted to adjust the alignment of the light-permitting regions of each screen in the second direction without altering the spacing between the adjacent translating screens;

wherein the combination of adjusting the spacing and adjusting the alignment enable independent adjustment of an amount of light permitted through the light-permitting regions from a first light source versus a second light source located at a different position than the first light source, and further wherein neither the spacing mechanism nor the alignment mechanism alters the substantially parallel relationship of each translating screen to the window.

2. The device of claim 1, further comprising a tracking system configured to track movement of the sun and further configured to drive the spacing mechanism to adjust the spacing in the first direction based on the tracked movement of the sun.

* * * * *